US011492758B2

(12) United States Patent
Mohammadi et al.

(10) Patent No.: US 11,492,758 B2
(45) Date of Patent: *Nov. 8, 2022

(54) FIBROUS STRUCTURES COMPRISING A SURFACE SOFTENING COMPOSITION

(71) Applicant: The Procter & Gamble Company, Cincinnati, OH (US)

(72) Inventors: Khosrow Parviz Mohammadi, Liberty Township, OH (US); Beth Ann Schubert, Maineville, OH (US); Jeffrey John Scheibel, Glendale, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 548 days.

This patent is subject to a terminal disclaimer.

(21) Appl. No.: 15/051,694

(22) Filed: Feb. 24, 2016

(65) Prior Publication Data

US 2016/0244915 A1 Aug. 25, 2016

Related U.S. Application Data

(60) Provisional application No. 62/120,523, filed on Feb. 25, 2015.

(51) Int. Cl.

| | |
|---|---|
| ***D21H 19/10*** | (2006.01) |
| ***D21H 21/14*** | (2006.01) |
| ***D21H 17/06*** | (2006.01) |
| ***D21H 17/02*** | (2006.01) |
| ***D21H 27/00*** | (2006.01) |

(52) U.S. Cl.

CPC ..... *D21H 19/10* (2013.01); *D21H 17/02* (2013.01); *D21H 17/06* (2013.01); *D21H 21/14* (2013.01); *D21H 27/002* (2013.01)

(58) Field of Classification Search

CPC ..... D21H 17/02; D21H 17/06; D21H 19/10; D21H 21/14; D21H 27/002

See application file for complete search history.

(56) References Cited

U.S. PATENT DOCUMENTS

| | | | |
|---|---|---|---|
| 4,214,038 | A | 7/1980 | McCarty et al. |
| 4,563,186 | A | 1/1986 | Flynn et al. |
| 5,466,719 | A | 11/1995 | Jakobson et al. |
| 5,558,071 | A | 9/1996 | Ward, V et al. |
| 5,587,155 | A | 12/1996 | Ochiai et al. |

(Continued)

FOREIGN PATENT DOCUMENTS

| | | | |
|---|---|---|---|
| CN | 1152335 | A | 6/1997 |
| CN | 104837977 | A | 8/2015 |

(Continued)

OTHER PUBLICATIONS

PCT International Search Report dated May 2, 2016—4 pages.

(Continued)

*Primary Examiner* — Frank J Vineis
*Assistant Examiner* — Laura B Figg
(74) *Attorney, Agent, or Firm* — Richard L. Alexander; Andrew J. Mueller

(57) ABSTRACT

Fibrous structures having thereon a surface softening composition containing a metathesized unsaturated polyol ester, sanitary tissue products made from such fibrous structures and methods for making same are provided.

18 Claims, 2 Drawing Sheets

(56) References Cited

U.S. PATENT DOCUMENTS

| | | | | |
|---|---|---|---|---|
| 5,879,584 | A | 3/1999 | Bianchetti et al. | |
| 6,126,784 | A * | 10/2000 | Ficke | D21H 23/72 162/111 |
| 6,420,013 | B1 * | 7/2002 | Vinson | D21H 19/74 162/113 |
| 6,492,315 | B1 | 12/2002 | Cao et al. | |
| 6,579,851 | B2 | 6/2003 | Goeke et al. | |
| 6,602,494 | B1 | 8/2003 | Jahedshoar et al. | |
| 6,727,215 | B2 | 4/2004 | Roberts et al. | |
| 7,833,516 | B2 | 11/2010 | Fack et al. | |
| 7,833,517 | B2 | 11/2010 | Fack et al. | |
| 7,871,601 | B2 | 1/2011 | Watanabe | |
| 8,115,021 | B2 | 2/2012 | Tupy | |
| 8,461,129 | B2 | 6/2013 | Bolduc et al. | |
| 8,501,973 | B2 | 8/2013 | Schrodi et al. | |
| 8,603,960 | B2 | 12/2013 | Panandiker et al. | |
| 8,603,961 | B2 | 12/2013 | Panandiker | |
| 8,642,824 | B2 | 2/2014 | Lemke et al. | |
| 8,692,006 | B2 | 4/2014 | Uptain et al. | |
| 8,748,646 | B2 | 6/2014 | Kluesener et al. | |
| 8,815,257 | B2 | 8/2014 | Braksmayer et al. | |
| 8,936,796 | B2 | 1/2015 | Kitko et al. | |
| 8,936,798 | B2 | 1/2015 | Kitko et al. | |
| 8,957,268 | B2 | 2/2015 | Cohen et al. | |
| 9,080,130 | B2 | 7/2015 | Sivik | |
| 9,382,189 | B2 | 7/2016 | Dubois et al. | |
| 10,285,928 | B2 | 5/2019 | Marsh et al. | |
| 10,479,960 | B2 | 11/2019 | Mohammadi et al. | |
| 10,640,735 | B2 | 5/2020 | Schubert et al. | |
| 2003/0069164 | A1 | 4/2003 | Levinson | |
| 2003/0134771 | A1 | 7/2003 | Ellson et al. | |
| 2003/0216282 | A1 | 11/2003 | Martens | |
| 2004/0142840 | A1 | 7/2004 | De Buzzaccarini et al. | |
| 2004/0234491 | A1 | 11/2004 | Brautigam et al. | |
| 2005/0180942 | A1 | 8/2005 | Shimizu et al. | |
| 2006/0018863 | A1 | 1/2006 | Mougin et al. | |
| 2006/0019867 | A1 | 1/2006 | Demeyere et al. | |
| 2007/0202063 | A1 | 8/2007 | Dihora et al. | |
| 2007/0275866 | A1 | 11/2007 | Dykstra | |
| 2007/0298004 | A1 | 12/2007 | Li | |
| 2008/0060201 | A1 | 3/2008 | Kwiecien | |
| 2008/0081055 | A1 | 4/2008 | Cassin | |
| 2008/0087395 | A1 * | 4/2008 | Prodoehl | D21H 27/005 162/127 |
| 2009/0048459 | A1 | 2/2009 | Tupy | |
| 2009/0188637 | A1 | 7/2009 | Chan et al. | |
| 2009/0217568 | A1 | 9/2009 | Murphy et al. | |
| 2009/0220443 | A1 | 9/2009 | Braksmayer et al. | |
| 2009/0324527 | A1 | 12/2009 | Okada et al. | |
| 2009/0324528 | A1 | 12/2009 | Okada et al. | |
| 2009/0324529 | A1 | 12/2009 | Okada et al. | |
| 2009/0324531 | A1 | 12/2009 | Okada et al. | |
| 2009/0324532 | A1 | 12/2009 | Okada et al. | |
| 2010/0047499 | A1 | 2/2010 | Braksmayer et al. | |
| 2010/0145086 | A1 | 6/2010 | Schrodi et al. | |
| 2010/0251485 | A1 | 10/2010 | Smets | |
| 2011/0028412 | A1 | 2/2011 | Cappello et al. | |
| 2011/0113679 | A1 | 5/2011 | Cohen et al. | |
| 2011/0135587 | A1 | 6/2011 | Kinoshita et al. | |
| 2011/0160472 | A1 | 6/2011 | Lemke et al. | |
| 2011/0197447 | A1 | 8/2011 | Stephens | |
| 2011/0197448 | A1 | 8/2011 | Stephens | |
| 2011/0197449 | A1 | 8/2011 | Stephens | |
| 2011/0201533 | A1 | 8/2011 | Ponder et al. | |
| 2011/0219621 | A1 | 9/2011 | Royle | |
| 2012/0020909 | A1 | 1/2012 | Courel et al. | |
| 2013/0041004 | A1 | 2/2013 | Drager | |
| 2013/0084243 | A1 | 4/2013 | Goetsch | |
| 2013/0096073 | A1 | 4/2013 | Sidelman | |
| 2013/0118014 | A1 | 5/2013 | Stephens et al. | |
| 2013/0118531 | A1 | 5/2013 | Dobrawa | |
| 2013/0280174 | A1 | 10/2013 | Lipic et al. | |
| 2013/0280192 | A1 | 10/2013 | Carter et al. | |
| 2013/0280193 | A1 | 10/2013 | Carter et al. | |
| 2013/0280356 | A1 | 10/2013 | Stella et al. | |
| 2013/0281551 | A1 | 10/2013 | Stella et al. | |
| 2013/0310301 | A1 | 11/2013 | Sivik et al. | |
| 2013/0344012 | A1 * | 12/2013 | Cohen | C11C 3/00 424/59 |
| 2014/0255330 | A1 | 9/2014 | Cron et al. | |
| 2014/0275595 | A1 | 9/2014 | Wampler et al. | |
| 2014/0275681 | A1 | 9/2014 | Cohen et al. | |
| 2014/0302103 | A1 | 10/2014 | Carter et al. | |
| 2014/0309154 | A1 | 10/2014 | Carter et al. | |
| 2014/0357714 | A1 | 12/2014 | Braksmayer et al. | |
| 2014/0366381 | A1 | 12/2014 | Phipps et al. | |
| 2014/0377205 | A1 | 12/2014 | Uehara et al. | |
| 2015/0105566 | A1 | 4/2015 | Cohen et al. | |
| 2015/0059995 | A1 | 5/2015 | Ramaratnam et al. | |
| 2015/0360015 | A1 | 12/2015 | Rabe et al. | |
| 2015/0360016 | A1 | 12/2015 | Rabe et al. | |
| 2015/0376108 | A1 | 12/2015 | Dubois et al. | |
| 2016/0023989 | A1 | 1/2016 | Allen et al. | |
| 2016/0067153 | A1 | 3/2016 | Chen et al. | |
| 2016/0090555 | A1 | 3/2016 | Frankenbach et al. | |
| 2016/0095807 | A1 | 4/2016 | Stella et al. | |
| 2016/0095808 | A1 | 4/2016 | Okada et al. | |
| 2016/0095809 | A1 | 4/2016 | Stella et al. | |
| 2016/0177217 | A1 | 6/2016 | Moloney et al. | |
| 2016/0177218 | A1 | 6/2016 | Moloney et al. | |
| 2016/0244698 | A1 | 8/2016 | Schubert et al. | |
| 2016/0244915 | A1 | 8/2016 | Mohammadi et al. | |
| 2017/0009184 | A1 | 1/2017 | Schubert et al. | |
| 2017/0009402 | A1 | 1/2017 | Mohammadi et al. | |
| 2018/0008484 | A1 | 1/2018 | Klofta et al. | |
| 2018/0008520 | A1 | 1/2018 | Zannoni et al. | |
| 2018/0008843 | A1 | 1/2018 | Zannoni et al. | |
| 2018/0010060 | A1 | 1/2018 | Zannoni et al. | |
| 2018/0049969 | A1 | 2/2018 | Stella et al. | |
| 2018/0049970 | A1 | 2/2018 | Stella et al. | |
| 2018/0051235 | A1 | 2/2018 | Schubert et al. | |
| 2018/0072968 | A1 | 3/2018 | Schubert et al. | |
| 2018/0085288 | A1 | 3/2018 | Marsh et al. | |
| 2018/0092820 | A1 | 4/2018 | Stella et al. | |
| 2018/0092825 | A1 | 4/2018 | Stella et al. | |
| 2018/0161474 | A1 | 6/2018 | Klofta et al. | |

FOREIGN PATENT DOCUMENTS

| | | |
|---|---|---|
| EP | 0 472 184 | 10/1994 |
| GB | 1 571 527 | 7/1980 |
| JP | H107532 | 1/1998 |
| WO | WO 2007/103398 A1 | 9/2007 |
| WO | WO 2008/091681 A2 | 7/2008 |
| WO | WO 2009/020665 | 2/2009 |
| WO | WO 2009/020667 | 2/2009 |
| WO | WO 2010/019727 | 2/2010 |
| WO | WO 2012/009525 | 1/2012 |
| WO | 2013040115 A1 | 3/2013 |
| WO | WO 2013/192384 | 12/2013 |
| WO | WO 2014/058872 | 4/2014 |

OTHER PUBLICATIONS

International Search Report; International Application No. PCT/US2016/018372; dated Jun. 7, 2016; 10 pages.

All Office Actions U.S. Appl. No. 15/203,838; U.S. Appl. No. 15/240,259; U.S. Appl. No. 15/203,838.

Schrock, Richard R., et al.; Molybdenum and Tungsten Imido Alkylidene Complexes as Efficient Olefin-Metathesis Catalysts; Angewandte Chemie Int. Ed.; 2003; pp. 4592-4633; vol. 42.

Schrock, Richard R.; High Oxidation State Multiple Metal—Carbon Bonds; Chemical Reviews; 2002; pp. 145-179; vol. 102; No. 1.

Schrock, Richard R.; Recent Advances in High Oxidation State Mo and W Imido Alkylidene Chemistry; Chemical Reviews; 2009; pp. 3211-3226; vol. 109; No. 8.

U.S. Appl. No. 15/044,312, filed Feb. 16, 2016, Jeffrey John Scheibel Beth Ann Schubert Rajan Keshav Panandiker.

U.S. Appl. No. 15/044,312, filed Feb. 16, 2016, Jeffrey John Scheibel, et al.

(56) References Cited

OTHER PUBLICATIONS

U.S. Appl. No. 15/240,259, filed Aug. 18, 2016, Schubert, et al.
U.S. Appl. No. 15/203,838, filed Jul. 7, 2016, Mohammadi, et al.
Encyclopedia of Polymer Science and Engineering, vol. 15, 2d ed., pp. 204-308, "Silicones" John Wiley & Sons, Inc. (1989).
"DPG-Industrial", Data Sheet, Shell Chemicals, Issued Oct. 23, 2009.
Written Opinion.
All Office Actions, U.S. Appl. No. 15/787,763.
"Benzyl alcohol" from Wikipedia, last modified Feb. 2, 2016, printed Mar. 15, 2016.
"Tallow Amines", Chemicalland21.com, printed Mar. 16, 2016.
"Myristic acid", from Wikipedia, last modified Dec. 3, 2015, printed Mar. 15, 2016.
All Office Actions, U.S. Appl. No. 15/203,823.
All Office Actions, U.S. Appl. No. 15/785,682.
Starch, M., "New Cosmetic Ingredients Based on Soybean Oil," ip.com Journal, ip.com Inc., West Henrietta, NY, US, Jun. 15, 2007, XP013120951, ISSN: 1533-0001; pp. 11-12.
Univar: Dow Corning® HY-3050 Soy Wax, (Apr. 10, 2008), 3 pages.

* cited by examiner

FIBROUS STRUCTURES COMPRISING A SURFACE SOFTENING COMPOSITION

FIELD OF THE INVENTION

The present invention relates to fibrous structures and sanitary tissue products comprising such fibrous structures. More particularly, the present invention relates to fibrous structures comprising a surface softening composition comprising a metathesized unsaturated polyol ester, sanitary tissue products comprising such fibrous structures and methods for making same.

BACKGROUND OF THE INVENTION

Fibrous structures comprising surface softening compositions are known in the art. Silicones and quaternary ammonium compounds have been widely used in the past as surface softening agents within surface softening compositions for various fibrous structures from textiles and fabrics to sanitary tissue products, such as toilet paper, facial tissue, paper towels, and wipes.

Unfortunately, the current surface softening agents have a number of drawbacks which include high cost, a narrow pH formulation window, less than desirable stability and/or softening performance. In an effort to alleviate such drawbacks, new surface softening agents have continued to be developed. Unfortunately, even such newly developed surface softening agents continue to exhibit one or more of the abovementioned drawbacks. Applicants recognized that the aforementioned drawbacks are due to one or more of the following factors: hydrolytic instability of ester linkage which is beta to the quaternary ammonium group in the molecule causes pH intolerance, the high charge density of quaternary ammonium headgroup causes salt intolerance, and excessively high molecular weights of the polymeric softening agents makes them difficult to process and dispose of. Thus what is required are surface softening agents that comprise a material that functions to soften the fibrous structures they are applied to, but does not exhibit the same level of drawbacks as current surface softening agents.

Accordingly, there is a need for surface softening agents that when applied to a surface of a fibrous structure provides the fibrous structure with softness without the drawbacks discussed above, sanitary tissue products comprising such fibrous structures, and methods for making same.

SUMMARY OF THE INVENTION

The present invention fulfills the need described above by providing a fibrous structure comprising a surface softening composition comprising a metathesized unsaturated polyol ester. Applicants unexpectedly found that metathesized unsaturated polyol esters can serve as a surface softening agent without exhibiting the drawbacks mentioned above. While not being bound by theory, Applicants believe that the uncharged nature and/or the low degree of oligomerization of the metathesized unsaturated polyol esters result in the lack of the aforementioned drawbacks. Thus metathesized unsaturated polyol esters are salt and pH tolerant as well as easier to process and dispose of, yet have a softening capability that is at least as good as that of the best current surface softening agents. As a result, formulations comprising such metathesized unsaturated polyol esters can have wide pH ranges, and/or salt levels and still be stable. In addition, the salt and/or pH tolerance of such formulations allows a number of additional ingredients to be employed by the formulator, including ingredients that hitherto were not available to formulators.

In one example of the present invention, a fibrous structure comprising a surface softening composition comprising a metathesized unsaturated polyol ester, is provided.

In another example of the present invention, a fibrous structure comprising a surface softening composition comprising a metathesized unsaturated polyol ester and being substantially free of silicones and quaternary ammonium surface softening agents, is provided.

In even another example of the present invention, a fibrous structure comprising a surface softening composition comprising a methathesized unsaturated polyol ester and one or more other surface softening agents selected from the group consisting of: silicones, quaternary ammonium compounds, and mixtures thereof, is provided.

In still another example of the present invention, a fibrous structure comprising a surface softening composition comprising a metathesized unsaturated polyol ester and a lotion composition, are provided.

In yet another example of the present invention, a process for treating a surface of a fibrous structure, the process comprising the step of applying a surface softening composition comprising a metathesized unsaturated polyol ester to the surface of the fibrous structure, is provided.

In even yet another example of the present invention, a single- or multi-ply sanitary tissue product comprising a fibrous structure according to the present invention, is provided.

Accordingly, the present invention provides fibrous structures comprising a surface softening composition comprising a metathesized unsaturated polyol ester, sanitary tissue products comprising such fibrous structures, and processes for making such fibrous structures.

DETAILED DESCRIPTION OF THE INVENTION

Definitions

Figure 1:
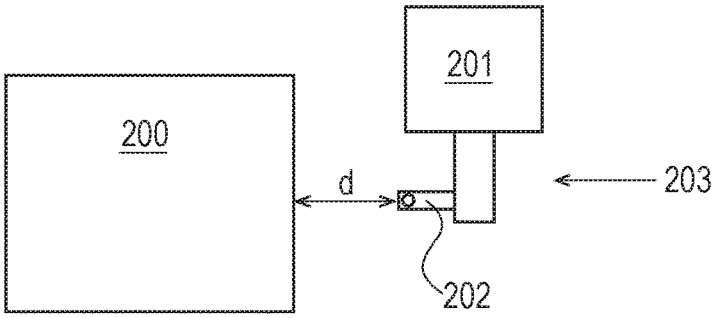
FIG. 1 is a schematic top view representation of a Slip Stick Coefficient of Friction Test Method set-up.

The terms "natural oils," "natural feedstocks," or "natural oil feedstocks" may refer to oils derived from plants or animal sources. The term "natural oil" includes natural oil derivatives, unless otherwise indicated. The terms also include modified plant or animal sources (e.g., genetically modified plant or animal sources), unless indicated otherwise. Examples of natural oils include, but are not limited to, vegetable oils, algae oils, fish oils, animal fats, tall oils, derivatives of these oils, combinations of any of these oils, and the like. Representative non-limiting examples of vegetable oils include canola oil, rapeseed oil, coconut oil, corn oil, cottonseed oil, olive oil, palm oil, peanut oil, safflower oil, sesame oil, soybean oil, sunflower oil, linseed oil, palm kernel oil, tung oil, jatropha oil, mustard oil, pennycress oil, camelina oil, and castor oil. Representative non-limiting examples of animal fats include lard, tallow, poultry fat, yellow grease, and fish oil. Tall oils are by-products of wood pulp manufacture.

The term "natural oil derivatives" refers to derivatives thereof derived from natural oil. The methods used to form these natural oil derivatives may include one or more of addition, neutralization, overbasing, saponification, transesterification, esterification, amidification, hydrogenation, isomerization, oxidation, alkylation, acylation, sulfurization, sulfonation, rearrangement, reduction, fermentation, pyrolysis, hydrolysis, liquefaction, anaerobic digestion, hydrothermal processing, gasification or a combination of two or more thereof. Examples of natural derivatives thereof may include carboxylic acids, gums, phospholipids, soapstock, acidulated soapstock, distillate or distillate sludge, fatty acids, fatty acid esters, as well as hydroxy substituted variations thereof, including unsaturated polyol esters. In some embodiments, the natural oil derivative may comprise an unsaturated carboxylic acid having from about 5 to about 30 carbon atoms, having one or more carbon-carbon double bonds in the hydrocarbon (alkene) chain. The natural oil derivative may also comprise an unsaturated fatty acid alkyl (e.g., methyl) ester derived from a glyceride of natural oil. For example, the natural oil derivative may be a fatty acid methyl ester ("FAME") derived from the glyceride of the natural oil. In some embodiments, a feedstock includes canola or soybean oil, as a non-limiting example, refined, bleached, and deodorized soybean oil (i.e., RBD soybean oil).

The term "low-molecular-weight olefin" may refer to any one or combination of unsaturated straight, branched, or cyclic hydrocarbons in the $C_2$ to $C_{14}$ range. Low-molecular-weight olefins include "alpha-olefins" or "terminal ole-fins," wherein the unsaturated carbon-carbon bond is present at one end of the compound. Low-molecular-weight olefins may also include dienes or trienes. Examples of low-molecular-weight olefins in the $C_2$ to $C_6$ range include, but are not limited to: ethylene, propylene, 1-butene, 2-butene, isobutene, 1-pentene, 2-pentene, 3-pentene, 2-methyl-lbutene, 2-methyl-2-butene, 3-methyl-1-butene, cyclopentene, 1-hexene, 2-hexene, 3-hexene, 4-hexene, 2-methyl-1-pentene, 3-methyl-1-pentene, 4-methyl-1-pentene, 2-methyl-2-pentene, 3-methyl-2-pentene, 4-methyl-2-pentene, 2-methyl-3-pentene, and cyclohexene. Other possible low-molecular-weight olefins include styrene and vinyl cyclohexane. In certain embodiments, it is preferable to use a mixture of olefins, the mixture comprising linear and branched low-molecular-weight olefins in the $C_4$-$C_{10}$ range. In one embodiment, it may be preferable to use a mixture of linear and branched $C_4$ olefins (i.e., combinations of: 1-butene, 2-butene, and/or isobutene). In other embodiments, a higher range of $C_{11}$-$C_{14}$ may be used.

The term "metathesis monomer" refers to a single entity that is the product of a metathesis reaction which comprises a molecule of a compound with one or more carbon-carbon double bonds which has undergone an alkylidene unit interchange via one or more of the carbon-carbon double bonds either within the same molecule (intramolecular metathesis) and/or with a molecule of another compound containing one or more carbon-carbon double bonds such as an olefin (intermolecular metathesis).

The term "metathesis dimer" refers to the product of a metathesis reaction wherein two reactant compounds, which can be the same or different and each with one or more carbon-carbon double bonds, are bonded together via one or more of the carbon-carbon double bonds in each of the reactant compounds as a result of the metathesis reaction.

The term "metathesis trimer" refers to the product of one or more metathesis reactions wherein three molecules of two or more reactant compounds, which can be the same or different and each with one or more carbon-carbon double bonds, are bonded together via one or more of the carbon-carbon double bonds in each of the reactant compounds as a result of the one or more metathesis reactions, the trimer containing three bonded groups derived from the reactant compounds.

The term "metathesis tetramer" refers to the product of one or more metathesis reactions wherein four molecules of two or more reactant compounds, which can be the same or different and each with one or more carbon-carbon double bonds, are bonded together via one or more of the carbon-carbon double bonds in each of the reactant compounds as a result of the one or more metathesis reactions, the tetramer containing four bonded groups derived from the reactant compounds.

The term "metathesis pentamer" refers to the product of one or more metathesis reactions wherein five molecules of two or more reactant compounds, which can be the same or different and each with one or more carbon-carbon double bonds, are bonded together via one or more of the carbon-carbon double bonds in each of the reactant compounds as a result of the one or more metathesis reactions, the pentamer containing five bonded groups derived from the reactant compounds.

The term "metathesis hexamer" refers to the product of one or more metathesis reactions wherein six molecules of two or more reactant compounds, which can be the same or different and each with one or more carbon-carbon double bonds, are bonded together via one or more of the carbon-carbon double bonds in each of the reactant compounds as a result of the one or more metathesis reactions, the hexamer containing six bonded groups derived from the reactant compounds.

The term "metathesis heptamer" refers to the product of one or more metathesis reactions wherein seven molecules of two or more reactant compounds, which can be the same or different and each with one or more carbon-carbon double bonds, are bonded together via one or more of the carbon-carbon double bonds in each of the reactant compounds as a result of the one or more metathesis reactions, the heptamer containing seven bonded groups derived from the reactant compounds.

The term "metathesis octamer" refers to the product of one or more metathesis reactions wherein eight molecules of two or more reactant compounds, which can be the same or different and each with one or more carbon-carbon double bonds, are bonded together via one or more of the carbon-carbon double bonds in each of the reactant compounds as a result of the one or more metathesis reactions, the octamer containing eight bonded groups derived from the reactant compounds.

The term "metathesis nonamer" refers to the product of one or more metathesis reactions wherein nine molecules of two or more reactant compounds, which can be the same or different and each with one or more carbon-carbon double bonds, are bonded together via one or more of the carbon-carbon double bonds in each of the reactant compounds as a result of the one or more metathesis reactions, the nonamer containing nine bonded groups derived from the reactant compounds.

The term "metathesis decamer" refers to the product of one or more metathesis reactions wherein ten molecules of two or more reactant compounds, which can be the same or different and each with one or more carbon-carbon double bonds, are bonded together via one or more of the carbon-carbon double bonds in each of the reactant compounds as a result of the one or more metathesis reactions, the decamer containing ten bonded groups derived from the reactant compounds.

The term "metathesis oligomer" refers to the product of one or more metathesis reactions wherein two or more molecules (e.g., 2 to about 10, or 2 to about 4) of two or more reactant compounds, which can be the same or different and each with one or more carbon-carbon double bonds, are bonded together via one or more of the carbon-carbon double bonds in each of the reactant compounds as a result of the one or more metathesis reactions, the oligomer containing a few (e.g., 2 to about 10, or 2 to about 4) bonded groups derived from the reactant compounds. In some embodiments, the term "metathesis oligomer" may include metathesis reactions wherein greater than ten molecules of two or more reactant compounds, which can be the same or different and each with one or more carbon-carbon double bonds, are bonded together via one or more of the carbon-carbon double bonds in each of the reactant compounds as a result of the one or more metathesis reactions, the oligomer containing greater than ten bonded groups derived from the reactant compounds.

"Fiber" as used herein means an elongate particulate having an apparent length greatly exceeding its apparent diameter, i.e. a length to diameter ratio of at least about 10. Fibers having a non-circular cross-section are common; the "diameter" in this case may be considered to be the diameter of a circle having cross-sectional area equal to the cross-sectional area of the fiber. More specifically, as used herein, "fiber" refers to papermaking fibers. The present invention contemplates the use of a variety of papermaking fibers, such as, for example, natural fibers or synthetic fibers, or any other suitable fibers, and any combination thereof.

Natural papermaking fibers useful in the present invention include animal fibers, mineral fibers, plant fibers and mixtures thereof. Animal fibers may, for example, be selected from the group consisting of: wool, silk and mixtures thereof. Plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah, and mixtures thereof. In one example the fibers comprise trichomes, such as trichomes obtained from *Stachys bzyantina*, for example trichomes from a Lamb's Ear plant.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered fibrous structure. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Non-limiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Non-limiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); and mixtures thereof.

"Fibrous structure" as used herein means a structure that comprises one or more fibers. Non-limiting examples of processes for making fibrous structures include known wet-laid papermaking processes and air-laid papermaking processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. For example, in typical papermaking processes, the finished fibrous structure is the fibrous structure that is wound on the reel at the end of papermaking, but before converting thereof into a sanitary tissue product.

Non-limiting types of fibrous structures according to the present invention include conventionally felt-pressed fibrous structures; pattern densified fibrous structures; and high-bulk, uncompacted fibrous structures. The fibrous structures may be of a homogeneous or multilayered ("layered" meaning two or three or more layers) construction; and the sanitary tissue products made therefrom may be of a single-ply or multi-ply construction.

The fibrous structures may be post-processed, such as by embossing and/or calendaring and/or folding and/or printing images thereon.

The fibrous structures may be through-air-dried fibrous structures or conventionally dried fibrous structures.

The fibrous structures may be creped or uncreped. In one example, the fibrous structures may be belt-creped and/or fabric creped.

"Sanitary tissue product" comprises one or more fibrous structures, converted or not, that is useful as a wiping implement for post-urinary and post-bowel movement cleaning (toilet tissue), for otorhinolaryngological discharges (facial tissue and/or disposable handkerchiefs), and multi-functional absorbent and cleaning uses (absorbent towels and/or wipes). In one example, a lotion composition-containing multi-ply disposable handkerchief having a caliper of from about 0.1 mm to about 0.4 mm in accordance with the present invention is provided.

"Ply" or "Plies" as used herein means an individual finished fibrous structure optionally to be disposed in a substantially contiguous, face-to-face relationship with other plies, forming a multiple ply finished fibrous structure product and/or sanitary tissue product. It is also contemplated that a single fibrous structure can effectively form two "plies" or multiple "plies", for example, by being folded on itself.

"Surface of a fibrous structure" as used herein means that portion of the fibrous structure that is exposed to the external environment. In other words, the surface of a fibrous structure is that portion of the fibrous structure that is not completely surrounded by other portions of the fibrous structure.

"User Contacting Surface" as used herein means that portion of the fibrous structure and/or surface softening composition and/or lotion composition present directly and/or indirectly on the surface of the fibrous structure that is exposed to the external environment. In other words, it is that surface formed by the fibrous structure including any surface softening composition and/or lotion composition present directly and/or indirectly on the surface of the fibrous structure that contacts an opposing surface when used by a user. For example, it is that surface formed by the fibrous structure including any surface softening composition and/or lotion composition present directly and/or indirectly on the surface of the fibrous structure that contacts a user's skin when a user wipes his/her skin with the fibrous structure of the present invention.

In one example, the user contacting surface, especially for a textured and/or structured fibrous structure, such as a through-air-dried fibrous structure and/or an embossed fibrous structure, may comprise raised areas and recessed areas of the fibrous structure. In the case of a through-air-dried, pattern densified fibrous structure the raised areas may be knuckles and the recessed areas may be pillows and vice versa. Accordingly, the knuckles may, directly and/or indirectly, comprise the surface softening composition and lotion composition and the pillows may be void of the surface softening composition and the lotion composition and vice versa so that when a user contacts the user's skin with the fibrous structure, only the lotion composition contacts the user's skin. A similar case is true for embossed fibrous structures where the embossed areas may, directly and/or indirectly, comprise the surface softening composition and the lotion composition and the non-embossed areas may be void of the surface softening composition and the lotion composition and vice versa.

The user contacting surface may be present on the fibrous structure and/or sanitary tissue product before use by the user and/or the user contacting surface may be created/formed prior to and/or during use of the fibrous structure and/or sanitary tissue product by the user, such as upon the user applying pressure to the fibrous structure and/or sanitary tissue product as the user contacts the user's skin with the fibrous structure and/or sanitary tissue product.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Structure

The fibrous structure according to the present invention comprises a surface comprising a surface softening composition comprising a surface softening agent comprising a metathesized unsaturated polyol ester.

In another example, the surface of the fibrous structure may comprise a layer of a surface softening composition according to the present invention and a layer a different surface softening composition and/or a lotion composition. The layers of the surface softening compositions and/or lotion composition may be phase registered with one another. In another example, the different surface softening compositions and/or lotion composition may cover different regions of the surface of the fibrous structure, for example they may be in a striped configuration.

In still another example, the surface softening composition of the present invention may cover about 100% and/or greater than 98% and/or greater than 95% and/or greater than 90% of the surface area of the surface of the fibrous structure.

The surface softening composition and/or lotion composition may be applied to a surface of the fibrous structure by any suitable means known in the art. Any contact or contact-free application suitable for applying the surface softening composition, such as spraying, dipping, padding, printing, slot extruding, such as in rows or patterns, rotogravure printing, flexographic printing, offset printing, screen printing, mask or stencil application process and mixtures thereof can be used to apply the surface softening composition and/or lotion composition to the surface of the fibrous structure and/or sanitary tissue product. Surface softening compositions can be applied to the fibrous structure and/or sanitary tissue product before, concurrently, or after the lotion composition application to the fibrous structure and/or sanitary tissue product.

In one example, the surface softening composition and/or the lotion composition is applied to the surface of the fibrous structure during the fibrous structure making process, such as before and/or after drying the fibrous structure.

In another example, the surface softening composition and/or the lotion composition is applied to the surface of the fibrous structure during the converting process.

In yet another example, the surface softening composition is applied to the surface of a fibrous structure prior to application of the lotion composition.

The surface softening composition can be applied during papermaking and/or converting, especially if applied to the outside layer of a layered fibrous structure and/or sanitary tissue product comprising such layered fibrous structure.

The surface softening composition and lotion composition can be applied by separate devices or by a single device that has two or more chambers capable of separately delivering the different compositions, especially incompatible, different compositions, such as the surface softening composition and the lotion composition.

The application devices may be sequentially arranged along the papermaking (fibrous structure making) and/or converting process.

The fibrous structures of the present invention may exhibit Slip Stick Coefficients of Friction of less than 360 and/or less than 355 and/or less than 350 and/or less than 325 and/or less than 300 and/or less than 285 (COF*10000) as measured according to the Slip Stick Coefficient of Friction Test Method described herein.

The fibrous structures of the present invention may exhibit TS7 Softness Values of less than 9 and/or less than 8.5 and/or less than 8 and/or less than 7.5 as measured according to the Softness Test Method described herein.

Surface Softening Composition

A surface softening composition, for purposes of the present invention, is a composition that improves the tactile sensation of a surface of a fibrous structure perceived by a user whom holds a fibrous structure and/or sanitary tissue product comprising the fibrous structure and rubs it across the user's skin. Such tactile perceivable softness can be characterized by, but is not limited to, friction, flexibility, and smoothness, as well as subjective descriptors, such as a feeling like lubricious, velvet, silk or flannel.

The surface softening composition may or may not be transferable. Typically, it is substantially non-transferable.

The surface softening composition may increase or decrease the surface friction of the surface of the fibrous structure, especially the user contacting surface of the fibrous structure. Typically, the surface softening composition will reduce the surface friction of the surface of the fibrous structure compared to a surface of the fibrous structure without such surface softening composition.

The surface softening composition comprises a surface softening agent. The surface softening composition during application to the fibrous structure may comprise at least about 0.1% and/or at least 0.5% and/or at least about 1% and/or at least about 3% and/or at least about 5% to 100% and/or to about 98% and/or to about 95% and/or to about 90% and/or to about 80% and/or to about 70% and/or to about 50% and/or to about 40% by weight of the surface softening agent. In one example, the surface softening composition comprises from about 5% to about 40% by weight of the surface softening agent. In one example, the surface softening composition comprises a metathesized unsaturated polyol ester as a surface softening agent.

The surface softening composition present on the fibrous structure and/or sanitary tissue product comprising the fibrous structure of the present invention may comprise at least about 0.01% and/or at least about 0.05% and/or at least about 0.1% of total basis weight of the surface softening agent, for example a metathesized unsaturated polyol ester. In one example, the fibrous structure and/or sanitary tissue product may comprise from about 0.01% to about 20% and/or from about 0.05% to about 15% and/or from about 0.1% to about 10% and/or from about 0.01% to about 5% and/or from about 0.1% to about 2% of total basis weight of the surface softening composition.

In one example, the surface softening composition may be present on and/or in the fibrous structure at a level of at least 1 #/ton and/or at least 5 #/ton and/or at least 10 #/ton and/or at least 15 #/ton.

Surface Softening Agents a. Metathesized Unsaturated Polyol Ester

Exemplary metathesized unsaturated polyol esters and their starting materials are set forth in U.S. Patent Applications U.S. 2009/0220443 A1, U.S. 2013/0344012 A1 and US 2014/0357714 A1, which are incorporated herein by reference. A metathesized unsaturated polyol ester refers to the product obtained when one or more unsaturated polyol ester ingredient(s) are subjected to a metathesis reaction. Metathesis is a catalytic reaction that involves the interchange of alkylidene units among compounds containing one or more double bonds (i.e., olefinic compounds) via the formation and cleavage of the carbon-carbon double bonds. Metathesis may occur between two of the same molecules (often referred to as self-metathesis) and/or it may occur between two different molecules (often referred to as cross-metathesis). Self-metathesis may be represented schematically as shown in Equation I.

$$R^1—CH{=}CH—R^2+R^1—CH{=}CH—R^2 \leftrightarrow R^1—CH{=}CH—R^1+R^2—CH{=}CH—R^2 \quad (I)$$

where $R^1$ and $R^2$ are organic groups.

Cross-metathesis may be represented schematically as shown in Equation II.

$$R^1—CH{=}CH—R^2+R^3—CH{=}CH—R^4 \leftrightarrow R^1—CH{=}CH—R^3+R—CH{=}CH—R^4+R^2—CH{=}CH—R^3+R^2—CH{=}CH—R^4+R^1—CH{=}CH—R^1+R^2—CH{=}CH—R^2+R^3—CH{=}CH—R^3+R^4—CH{=}CH—R^4 \quad (II)$$

where $R^1$, $R^2$, $R^3$, and $R^4$ are organic groups.

When a polyol ester comprises molecules having more than one carbon-carbon double bond, self-metathesis may result in oligomerization or polymerization of the unsaturates in the starting material. For example, Equation C depicts metathesis oligomerization of a representative species (e.g., a polyol ester) having more than one carbon-carbon double bond. In Equation C, the self-metathesis reaction results in the formation of metathesis dimers, metathesis trimers, and metathesis tetramers. Although not shown, higher order oligomers such as metathesis pentamers, hexamers, heptamers, octamers, nonamers, decamers, and higher than decamers, and mixtures of two or more thereof, may also be formed. The number of metathesis repeating units or groups in the metathesized natural oil may range from 1 to about 100, or from 2 to about 50, or from 2 to about 30, or from 2 to about 10, or from 2 to about 4. The molecular weight of the metathesis dimer may be greater than the molecular weight of the unsaturated polyol ester from which the dimer is formed. Each of the bonded polyol ester molecules may be referred to as a "repeating unit or group." Typically, a metathesis trimer may be formed by the cross-metathesis of a metathesis dimer with an unsaturated polyol ester. Typically, a metathesis tet-ramer may be formed by the cross-metathesis of a metathesis trimer with an unsaturated polyol ester or formed by the cross-metathesis of two metathesis dimers.

Equation C $$R^1—HC{=}CH—R^2—HC{=}CH—R^3+R^1—HC{=}CH—R^2—HC{=}CH—R^3 \leftrightarrow R^1—HC{=}CH—R^2—HC{=}CH—R^2—HC{=}CH—R^3+(\text{other products}) \quad (\text{metathesis dimer})$$

$$R^1—R^2—HC{=}CH—R^2—HC{=}CH—R^3+R^1—HC{=}CH—R^2—HC{=}CH—R^3 \leftrightarrow R^1—HC{=}CH—R^2—HC{=}CH—R^2—HC{=}CH—R^2—HC{=}CH—R^3+(\text{other products}) \quad (\text{metathesis trimer})$$

$$R^1—HC{=}CH—R^2—HC{=}CH—R^2—HC{=}CH—R^2—HC{=}CH—R^3+R^1—HC{=}CH—R^2—HC{=}CH—R^3 \leftrightarrow R^1—HC{=}CH—R^2—HC{=}CH—R^2—HC{=}CH—R^2—HC{=}CH—R^2—HC{=}CH—R^3+(\text{other products}) \quad (\text{metathesis tetramer})$$

where $R^1$, $R^2$, and $R^3$ are organic groups.

As a starting material, metathesized unsaturated polyol esters are prepared from one or more unsaturated polyol esters. As used herein, the term "unsaturated polyol ester" refers to a compound having two or more hydroxyl groups wherein at least one of the hydroxyl groups is in the form of an ester and wherein the ester has an organic group including at least one carbon-carbon double bond. In many embodiments, the unsaturated polyol ester can be represented by the general structure (I):

(I)

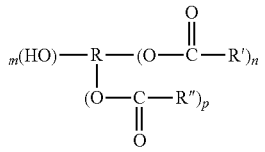

where n≥1;

m≥0;

p≥0;

(n+m+p)≥2;

R is an organic group;

R' is an organic group having at least one carbon-carbon double bond; and

R" is a saturated organic group.

In many embodiments of the invention, the unsaturated polyol ester is an unsaturated polyol ester of glycerol. Unsaturated polyol esters of glycerol have the general structure (II):

(II)

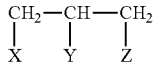

where —X, —Y, and —Z are independently selected from the group consisting of:

—OH; —(O—C(═O)—R'); and —(O—C(═O)—R");

where —R' is an organic group having at least one carbon-carbon double bond and —R" is a saturated organic group.

In structure (II), at least one of —X, —Y, and —Z is —(O—C(═O)—R').

In some embodiments, R' is a straight or branched chain hydrocarbon having about 50 or less carbon atoms (e.g., about 36 or less carbon atoms or about 26 or less carbon atoms) and at least one carbon-carbon double bond in its chain. In some embodiments, R' is a straight or branched chain hydrocarbon having about 6 carbon atoms or greater (e.g., about 10 carbon atoms or greater or about 12 carbon atoms or greater) and at least one carbon-carbon double bond in its chain. In some embodiments, R' may have two or more carbon-carbon double bonds in its chain. In other embodiments, R' may have three or more double bonds in its chain. In exemplary embodiments, R' has 17 carbon atoms and 1 to 3 carbon-carbon double bonds in its chain. Representative examples of R' include:

$$—(CH_2)_7CH═CH—(CH_2)_7—CH_3;$$

$$—(CH_2)_7CH═CH—CH_2—CH═CH—(CH_2)_4—CH_3; \text{ and}$$

$$—(CH_2)_7CH═CH—CH_2—CH═CH—CH_2—CH═CH—CH_2—CH_3.$$

In some embodiments, R" is a saturated straight or branched chain hydrocarbon having about 50 or less carbon atoms (e.g., about 36 or less carbon atoms or about 26 or less carbon atoms). In some embodiments, R" is a saturated straight or branched chain hydrocarbon having about 6 carbon atoms or greater (e.g., about 10 carbon atoms or greater or about 12 carbon atoms or greater. In exemplary embodiments, R" has 15 carbon atoms or 17 carbon atoms.

Sources of unsaturated polyol esters of glycerol include synthesized oils, natural oils (e.g., vegetable oils, algae oils, and animal fats), combinations of these, and the like. Representative examples of vegetable oils include canola oil, rapeseed oil, coconut oil, corn oil, cottonseed oil, olive oil, palm oil, peanut oil, safflower oil, sesame oil, soybean oil, sunflower oil, linseed oil, palm kernel oil, tung oil, castor oil, combinations of these, and the like. Representative examples of animal fats include lard, tallow, chicken fat, yellow grease, fish oil, combinations of these, and the like. A representative example of a synthesized oil includes tall oil, which is a byproduct of wood pulp manufacture.

Natural oils of the type described herein typically are composed of triglycerides of fatty acids. These fatty acids may be either saturated, monounsaturated or polyunsaturated and contain varying chain lengths ranging from C8 to C30. The most common fatty acids include saturated fatty acids such as lauric acid (dodecanoic acid), myristic acid (tetradecanoic acid), palmitic acid (hexadecanoic acid), stearic acid (octadecanoic acid), arachidic acid (eicosanoic acid), and lignoceric acid (tetracosanoic acid); unsaturated acids include such fatty acids as palmitoleic (a C16 acid), and oleic acid (a C18 acid); polyunsaturated acids include such fatty acids as linoleic acid (a di-unsaturated C18 acid), linolenic acid (a tri-unsaturated C18 acid), and arachidonic acid (a tetra-unsubstituted C20 acid). The natural oils are further comprised of esters of these fatty acids in random placement onto the three sites of the trifunctional glycerine molecule. Different natural oils will have different ratios of these fatty acids, and within a given natural oil there is a range of these acids as well depending on such factors as where a vegetable or crop is grown, maturity of the vegetable or crop, the weather during the growing season, etc. Thus, it is difficult to have a specific or unique structure for any given natural oil, but rather a structure is typically based on some statistical average. For example soybean oil contains a mixture of stearic acid, oleic acid, linoleic acid, and linolenic acid in the ratio of 15:24:50:11, and an average number of double bonds of 4.4-4.7 per triglyceride. One method of quantifying the number of double bonds is the iodine value (IV) which is defined as the number of grams of iodine that will react with 100 grams of vegetable oil. Therefore for soybean oil, the average iodine value range is from 120-140. Soybean oil may comprises about 95% by weight or greater (e.g., 99% weight or greater) triglycerides of fatty acids. Major fatty acids in the polyol esters of soybean oil include saturated fatty acids, as a non-limiting example, palmitic acid (hexadecanoic acid) and stearic acid (octadecanoic acid), and unsaturated fatty acids, as a non-limiting example, oleic acid (9-octadecenoic acid), linoleic acid (9,12octadecadienoic acid), and linolenic acid (9,12,15-octadecatrienoic acid).

In an exemplary embodiment, the vegetable oil is soybean oil, for example, refined, bleached, and deodorized soybean oil (i.e., RBD soybean oil). Soybean oil is an unsaturated polyol ester of glycerol that typically comprises about 95% weight or greater (e.g., 99% weight or greater) triglycerides of fatty acids. Major fatty acids in the polyol esters of soybean oil include saturated fatty acids, for example, palmitic acid (hexadecanoic acid) and stearic acid (octadecanoic acid), and unsaturated fatty acids, for example, oleic acid (9-octadecenoic acid), linoleic acid (9,12-octadecadienoic acid), and linolenic acid (9,12,15-octadecatrienoic acid). Soybean oil is a highly unsaturated vegetable oil with many of the triglyceride molecules having at least two unsaturated fatty acids (i.e., a polyunsaturated triglyceride).

In exemplary embodiments, an unsaturated polyol ester is self-metathesized in the presence of a metathesis catalyst to form a metathesized composition. In many embodiments, the metathesized composition comprises one or more of: metathesis monomers, metathesis dimers, metathesis trimers, metathesis tetramers, metathesis pentamers, and higher order metathesis oligomers (e.g., metathesis hexamers). A metathesis dimer refers to a compound formed when two unsaturated polyol ester molecules are covalently bonded to one another by a self-metathesis reaction. In many embodiments, the molecular weight of the metathesis dimer is greater than the molecular weight of the individual unsaturated polyol ester molecules from which the dimer is formed. A metathesis trimer refers to a compound formed when three unsaturated polyol ester molecules are covalently bonded together by metathesis reactions. In many embodiments, a metathesis trimer is formed by the cross-metathesis of a metathesis dimer with an unsaturated polyol ester. A metathesis tetramer refers to a compound formed when four unsaturated polyol ester molecules are covalently bonded together by metathesis reactions. In many embodiments, a metathesis tetramer is formed by the cross-metathesis of a metathesis trimer with an unsaturated polyol ester. Metathesis tetramers may also be formed, for example, by the cross-metathesis of two metathesis dimers. Higher order metathesis products may also be formed. For example, metathesis pentamers and metathesis hexamers may also be formed. The self-metathesis reaction also results in the formation of internal olefin compounds that may be linear or cyclic. If the metathesized polyol ester is hydrogenated, the linear and cyclic olefins would typically be converted to the corresponding saturated linear and cyclic hydrocarbons. The linear/cyclic olefins and saturated linear/cyclic hydrocarbons may remain in the metathesized polyol ester or they may be removed or partially removed from the metathesized polyol ester using known stripping techniques.

The relative amounts of monomers, dimers, trimers, tetramers, pentamers, and higher order oligomers may be determined by chemical analysis of the metathesized polyol ester including, for example, by liquid chromatography, specifically gel permeation chromatography (GPC). For example, the relative amount of monomers, dimers, trimers, tetramers and higher unit oligomers may be characterized, for example, in terms of area % or wt. %. That is, an area percentage of a GPC chromatograph can be correlated to weight percentage. In some embodiments, the metathesized unsaturated polyol ester comprises at least about 30 area % or wt. % tetramers and/or other higher unit oligomers or at least about 40 area % or wt. % tetramers and/or other higher unit oligomers. In some embodiments, the metathesized unsaturated polyol ester comprises no more than about 60 area % or wt. % tetramers and/or other higher unit oligomers or no more than about 50 area % or wt. % tetramers and/or other higher unit oligomers. In other embodiments, the metathesized unsaturated polyol ester comprises no more than about 1 area % or wt. % tetramers and/or other higher unit oligomers. In some embodiments, the metathesized unsaturated polyol ester comprises at least about 5 area % or wt. % dimers or at least about 15 area % or wt. % dimers. In some embodiments, the metathesized unsaturated polyol ester comprises no more than about 25 area % or wt. % dimers. In some of these embodiments, the metathesized unsaturated polyol ester comprises no more than about 20 area % or wt. % dimers or no more than about 10 area % or wt. % dimers. In some embodiments, the metathesized unsaturated polyol ester comprises at least 1 area % or wt. % trimers. In some of these embodiments, the metathesized unsaturated polyol ester comprises at least about 10 area % or wt. % trimers. In some embodiments, the metathesized unsaturated polyol ester comprises no more than about 20 area % or wt. % trimers or no more than about 10 area % or wt. % trimers.

According to some of these embodiments, the metathesized unsaturated polyol ester comprises no more than 1 area % or wt. % trimers.

In one example, the metathesized unsaturated polyol ester exhibits an iodine value (IV) in the range of from 5 to 100.

In some embodiments, the unsaturated polyol ester is partially hydrogenated before being metathesized. For example, in some embodiments, the soybean oil is partially hydrogenated to achieve an iodine value (IV) of about 120 or less before subjecting the partially hydrogenated soybean oil to metathesis.

In some embodiments, the hydrogenated metathesized polyol ester has an iodine value (IV) of about 100 or less, for example, about 90 or less, about 80 or less, about 70 or less, about 60 or less, about 50 or less, about 40 or less, about 30 or less, about 20 or less, about 10 or less or about 5 or less.

In some embodiments, the natural oil may be hydrogenated (e.g., fully or partially hydrogenated) in order to improve the stability of the oil or to modify its viscosity or other properties. Representative techniques for hydrogenating natural oils are known in the art and are discussed herein. In some embodiments, the natural oil is RBD soybean oil that has been lightly hydrogenated to achieve an Iodine Value (IV) of about 100 or greater, for example, about 100 to about 110. Suitable lightly hydrogenated RBD soybean oil is commercially available from Cargill, Incorporated (Minneapolis, Minn.)

In some embodiments, the natural oil is winterized. Winterization refers to the process of: (1) removing waxes and other non-triglyceride constituents, (2) removing naturally occurring high-melting triglycerides, and (3) removing high-melting triglycerides formed during partial hydrogenation. Winterization may be accomplished by known methods including, for example, cooling the oil at a controlled rate in order to cause crystallization of the higher melting components that are to be removed from the oil. The crystallized high melting components are then removed from the oil by filtration resulting in winterized oil. Winterized soybean oil is commercially available from Cargill, Incorporated (Minneapolis, Minn.)

In some embodiments, the polyol ester may comprise a mixture of two or more natural oils. For example, in some embodiments, the polyol ester may comprise a mixture of fully-hydrogenated soybean oil and partially or non-hydrogenated soybean oil. In other embodiments, the polyol ester may comprise a mixture of partially hydrogenated soybean oil and non-hydrogenated soybean oil. In yet other embodiments, the polyol ester may comprise a mixture of two or more different natural oils, for example, a mixture of soybean oil and castor oil. In exemplary embodiments, the petrolatum-like composition comprises a mixture of: (i) a hydrogenated metathesized vegetable oil; and (ii) a vegetable oil. For example, in some embodiments, the petrolatum-like composition comprises a mixture of: (i) hydrogenated metathesized soybean oil (HMSBO); and (ii) soybean oil. In some embodiments, the soybean oil is partially hydrogenated, for example, having an iodine value (IV) of about 80 to 120.

In other embodiments, the metathesized unsaturated polyol esters can be used as a blend with one or more other surface softening agents, such as quaternary ammonium compounds, silicones, unmetathesized unsatureated polyol esters, and mixtures thereof.

Non-limiting examples of suitable commercially available metathesized unsaturated polyol esters include Elevance Smooth CS-110 and Elevance Soft CG-100, from Elevance Renewable Sciences, Inc., Woodridge, Ill., and HY-3050 Soy Wax and HY-3051 Soy Wax Blend from Dow Corning.

Method of Making Metathesized Unsaturated Polyol Ester

The self-metathesis of unsaturated polyol esters is typically conducted in the presence of a catalytically effective amount of a metathesis catalyst. The term "metathesis catalyst" includes any catalyst or catalyst system that catalyzes a metathesis reaction. Any known or future-developed metathesis catalyst may be used, alone or in combination with one or more additional catalysts. Suitable homogeneous metathesis catalysts include combinations of a transition metal halide or oxo-halide (e.g., $WOCl_4$ or $WCl_6$) with an alkylating cocatalyst (e.g., $Me_4Sn$), or alkylidene (or carbene) complexes of transition metals, particularly Ru, Mo, or W. These include first and second-generation Grubbs catalysts, Grubbs-Hoveyda catalysts, and the like. Suitable alkylidene catalysts have the general structure $M[X^1X^2L^1L^2(L^3)_n]=C_m=C(R^1)R^2$ where M is a Group 8 transition metal, $L^1$, $L^2$, and $L^3$ are neutral electron donor ligands, n is 0 (such that $L^3$ may not be present) or 1, m is 0, 1, or 2, $X^1$ and $X^2$ are anionic ligands, and $R^1$ and $R^2$ are independently selected from H, hydrocarbyl, substituted hydrocarbyl, heteroatom-containing hydrocarbyl, substituted heteroatom-containing hydrocarbyl, and functional groups. Any two or more of $X^1$, $X^2$, $L^1$, $L^2$, $L^3$, $R^1$ and $R^2$ can form a cyclic group and any one of those groups can be attached to a support.

First-generation Grubbs catalysts fall into this category where m=n=0 and particular selections are made for n, $X^1$, $X^2$, $L^1$, $L^2$, $L^3$, $R^1$ and $R^2$ as described in U.S. Pat. Appl. Publ. No. 2010/0145086, the teachings of which related to all metathesis catalysts are incorporated herein by reference.

Second-generation Grubbs catalysts also have the general formula described above, but $L^1$ is a carbene ligand where the carbene carbon is flanked by N, O, S, or P atoms, preferably by two N atoms. Usually, the carbene ligand is part of a cyclic group. Examples of suitable second-generation Grubbs catalysts also appear in the '086 publication.

In another class of suitable alkylidene catalysts, $L^1$ is a strongly coordinating neutral electron donor as in first- and second-generation Grubbs catalysts, and $L^2$ and $L^3$ are weakly coordinating neutral electron donor ligands in the form of optionally substituted heterocyclic groups. Thus, $L^2$ and $L^3$ are pyridine, pyrimidine, pyrrole, quinoline, thiophene, or the like.

In yet another class of suitable alkylidene catalysts, a pair of substituents is used to form a bi- or tridentate ligand, such as a biphosphine, dialkoxide, or alkyldiketonate. Grubbs-Hoveyda catalysts are a subset of this type of catalyst in which $L^2$ and $R^2$ are linked. Typically, a neutral oxygen or nitrogen coordinates to the metal while also being bonded to a carbon that is α-, β-, or γ- with respect to the carbene carbon to provide the bidentate ligand. Examples of suitable Grubbs-Hoveyda catalysts appear in the '086 publication.

The structures below provide just a few illustrations of suitable catalysts that may be used:

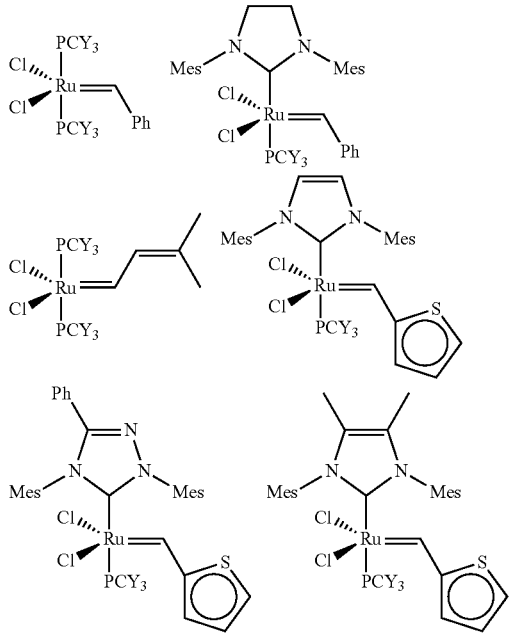

An immobilized catalyst can be used for the metathesis process. An immobilized catalyst is a system comprising a catalyst and a support, the catalyst associated with the support. Exemplary associations between the catalyst and the support may occur by way of chemical bonds or weak interactions (e.g. hydrogen bonds, donor acceptor interactions) between the catalyst, or any portions thereof, and the support or any portions thereof. Support is intended to include any material suitable to support the catalyst. Typically, immobilized catalysts are solid phase catalysts that act on liquid or gas phase reactants and products. Exemplary supports are polymers, silica or alumina. Such an immobilized catalyst may be used in a flow process. An immobilized catalyst can simplify purification of products and recovery of the catalyst so that recycling the catalyst may be more convenient.

In certain embodiments, prior to the metathesis reaction, a natural oil feedstock may be treated to render the natural oil more suitable for the subsequent metathesis reaction. In one embodiment, the treatment of the natural oil involves the removal of catalyst poisons, such as peroxides, which may potentially diminish the activity of the metathesis catalyst. Non-limiting examples of natural oil feedstock treatment methods to diminish catalyst poisons include those described in PCT/US2008/09604, PCT/US2008/09635, and U.S. patent application Ser. Nos. 12/672,651 and 12/672,652, herein incorporated by reference in their entireties. In certain embodiments, the natural oil feedstock is thermally treated by heating the feedstock to a temperature greater than 100° C. in the absence of oxygen and held at the temperature for a time sufficient to diminish catalyst poisons in the feedstock. In other embodiments, the temperature is between approximately 100° C. and 300° C., between approximately 120° C. and 250° C., between approximately 150° C. and 210° C., or approximately between 190 and 200° C. In one embodiment, the absence of oxygen is achieved by sparging the natural oil feedstock with nitrogen, wherein the nitrogen gas is pumped into the feedstock treatment vessel at a pressure of approximately 10 atm (150 psig).

In certain embodiments, the natural oil feedstock is chemically treated under conditions sufficient to diminish the catalyst poisons in the feedstock through a chemical reaction of the catalyst poisons. In certain embodiments, the feedstock is treated with a reducing agent or a cation-inorganic base composition. Non-limiting examples of reducing agents include bisulfate, borohydride, phosphine, thiosulfate, and combinations thereof.

In certain embodiments, the natural oil feedstock is treated with an adsorbent to remove catalyst poisons. In one embodiment, the feedstock is treated with a combination of thermal and adsorbent methods. In another embodiment, the feedstock is treated with a combination of chemical and adsorbent methods. In another embodiment, the treatment involves a partial hydrogenation treatment to modify the natural oil feedstocks reactivity with the metathesis catalyst. Additional non-limiting examples of feedstock treatment are also described below when discussing the various metathesis catalysts.

In certain embodiments, a ligand may be added to the metathesis reaction mixture. In many embodiments using a ligand, the ligand is selected to be a molecule that stabilizes the catalyst, and may thus provide an increased turnover number for the catalyst. In some cases the ligand can alter reaction selectivity and product distribution. Examples of ligands that can be used include Lewis base ligands, such as, without limitation, trialkylphosphines, for example tricyclohexylphosphine and tributyl phosphine; triarylphosphines, such as triphenylphosphine; diarylalkylphosphines, such as, diphenylcyclohexylphosphine; pyridines, such as 2,6-dimethylpyridine, 2,4,6-trimethylpyridine; as well as other Lewis basic ligands, such as phosphine oxides and phosphinites. Additives may also be present during metathesis that increase catalyst lifetime.

Any useful amount of the selected metathesis catalyst can be used in the process. For example, the molar ratio of the unsaturated polyol ester to catalyst may range from about 5:1 to about 10,000,000:1 or from about 50:1 to 500,000:1. In some embodiments, an amount of about 1 to about 10 ppm, or about 2 ppm to about 5 ppm, of the metathesis catalyst per double bond of the starting composition (i.e., on a mole/mole basis) is used.

In some embodiments, the metathesis reaction is catalyzed by a system containing both a transition and a non-transition metal component. The most active and largest number of catalyst systems are derived from Group VI A transition metals, for example, tungsten and molybdenum.

Multiple, sequential metathesis reaction steps may be employed. For example, the metathesized natural oil product may be made by reacting a natural oil in the presence of a metathesis catalyst to form a first metathesized natural oil product. The first metathesized natural oil product may then be reacted in a self-metathesis reaction to form another metathesized natural oil product. Alternatively, the first metathesized natural oil product may be reacted in a cross-metathesis reaction with a natural oil to form another metathesized natural oil product. Also in the alternative, the transesterified products, the olefins and/or esters may be further metathesized in the presence of a metathesis catalyst. Such multiple and/or sequential metathesis reactions can be performed as many times as needed, and at least one or more times, depending on the processing/compositional requirements as understood by a person skilled in the art. As used herein, a "metathesized natural oil product" may include products that have been once metathesized and/or multiply metathesized. These procedures may be used to form metathesis dimers, metathesis trimers, metathesis tetramers, metathesis pentamers, and higher order metathesis oligomers (e.g., metathesis hexamers, metathesis heptamers, metathesis octamers, metathesis nonamers, metathesis decamers, and higher than metathesis decamers). These procedures can be repeated as many times as desired (for example, from 2 to about 50 times, or from 2 to about 30 times, or from 2 to about 10 times, or from 2 to about 5 times, or from 2 to about 4 times, or 2 or 3 times) to provide the desired metathesis oligomer or polymer which may comprise, for example, from 2 to about 100 bonded groups, or from 2 to about 50, or from 2 to about 30, or from 2 to about 10, or from 2 to about 8, or from 2 to about 6 bonded groups, or from 2 to about 4 bonded groups, or from 2 to about 3 bonded groups. In certain embodiments, it may be desirable to use the metathesized natural products produced by cross metathesis of a natural oil, or blend of natural oils, with a C2-C100 olefin, as the reactant in a self-metathesis reaction to produce another metathesized natural oil product. Alternatively, metathesized natural products produced by cross metathesis of a natural oil, or blend of natural oils, with a C2-C100 olefin can be combined with a natural oil, or blend of natural oils, and further metathesized to produce another metathesized natural oil product.

The metathesized natural oil product may have a number average molecular weight in the range from about 100 g/mol to about 150,000 g/mol, or from about 300 g/mol to about 100,000 g/mol, or from about 300 g/mol to about 70,000 g/mol, or from about 300 g/mol to about 50,000 g/mol, or from about 500 g/mol to about 30,000 g/mol, or from about 700 g/mol to about 10,000 g/mol, or from about 1,000 g/mol to about 5,000 g/mol. The metathesized natural oil product may have a weight average molecular weight in the range from about from about 1,000 g/mol to about 100,000 g/mol, from about 2,500 g/mol to about 50,000 g/mol, from about 4,000 g/mol to about 30,000 g/mol, from about 5,000 g/mol to about 20,000 g/mol, and from about 6,000 g/mol to about 15,000 g/mol. The metathesized natural oil product may have a z-average molecular weight in the range from about from about 5,000 g/mol to about 1,000,000 g/mol, for example from about 7,500 g/mol to about 500,000 g/mol, from about 10,000 g/mol to about 300,000 g/mol, or from about 12,500 g/mol to about 200,000 g/mol. The polydispersity index is calculated by dividing the weight average molecular weight by the number average molecular weight. Polydispersity is a measure of the breadth of the molecular weight distribution of the metathesized natural oil product, and such products generally exhibit a polydispersity index of about 1 to about 20, or from about 2 to about 15. The number average molecular weight, weight average molecular weight, and z-average molecular weight is determined by gel permeation chromatography (GPC). In some embodiments, gas chromatography and gas chromatography mass-spectroscopy can be used to analyze the metathesized natural oil product by first transforming the triglycerides to their corresponding methyl esters prior to testing. The extent to which the individual triglyceride molecules have been polymerized can be understood as being directly related to the concentration of diester molecules found in the analyzed fatty acid methyl esters. In some embodiments, the molecular weight of the metathesized natural oil product can be increased by transesterifying the metathesized natural oil product with diesters. In some embodiments, the molecular weight of the metathesized natural oil product can be increased by esterifying the metathesized natural oil product with diacids. In certain embodiments, the metathesized natural oil product has a viscosity between about 1 centipoise (cP) and about 10,000 centipoise (cP), between about 30 centipoise (cP) and about 5000 cP, between about 50 cP and about 3000 cP, and from between about 80 cP and about 1500 cP.

The metathesis process can be conducted under any conditions adequate to produce the desired metathesis products. For example, stoichiometry, atmosphere, solvent, temperature, and pressure can be selected by one skilled in the art to produce a desired product and to minimize undesirable byproducts. The metathesis process may be conducted under an inert atmosphere. Similarly, if a reagent is supplied as a gas, an inert gaseous diluent can be used. The inert atmosphere or inert gaseous diluent typically is an inert gas, meaning that the gas does not interact with the metathesis catalyst to substantially impede catalysis. For example, particular inert gases are selected from the group consisting of helium, neon, argon, nitrogen, individually or in combinations thereof.

In certain embodiments, the metathesis catalyst is dissolved in a solvent prior to conducting the metathesis reaction. In certain embodiments, the solvent chosen may be selected to be substantially inert with respect to the metathesis catalyst. For example, substantially inert solvents include, without limitation, aromatic hydrocarbons, such as benzene, toluene, xylenes, etc.; halogenated aromatic hydrocarbons, such as chlorobenzene and dichlorobenzene; aliphatic solvents, including pentane, hexane, heptane, cyclohexane, etc.; and chlorinated alkanes, such as dichloromethane, chloroform, dichloroethane, etc. In one particular embodiment, the solvent comprises toluene. The metathesis reaction temperature may be a rate-controlling variable where the temperature is selected to provide a desired product at an acceptable rate. In certain embodiments, the metathesis reaction temperature is greater than about −40° C., greater than about −20° C., greater than about 0° C., or greater than about 10° C. In certain embodiments, the metathesis reaction temperature is less than about 150° C., or less than about 120° C. In one embodiment, the metathesis reaction temperature is between about 10° C. and about 120° C.

The metathesis reaction can be run under any desired pressure. Typically, it will be desirable to maintain a total pressure that is high enough to keep the cross-metathesis reagent in solution. Therefore, as the molecular weight of the cross-metathesis reagent increases, the lower pressure range typically decreases since the boiling point of the cross-metathesis reagent increases. The total pressure may be selected to be greater than about 0.1 atm (10 kPa), in some embodiments greater than about 0.3 atm (30 kPa), or greater than about 1 atm (100 kPa). Typically, the reaction pressure is no more than about 70 atm (7000 kPa), in some embodiments no more than about 30 atm (3000 kPa). A non-limiting exemplary pressure range for the metathesis reaction is from about 1 atm (100 kPa) to about 30 atm (3000 kPa). In certain embodiments it may be desirable to run the metathesis reactions under an atmosphere of reduced pressure. Conditions of reduced pressure or vacuum may be used to remove olefins as they are generated in a metathesis reaction, thereby driving the metathesis equilibrium towards the formation of less volatile products. In the case of a self-metathesis of a natural oil, reduced pressure can be used to remove C12 or lighter olefins including, but not limited to, hexene, nonene, and dodecene, as well as byproducts including, but not limited to cyclohexa-diene and benzene as the metathesis reaction proceeds. The removal of these species can be used as a means to drive the reaction towards the formation of diester groups and cross linked triglycerides.

Hydrogenation:

In some embodiments, the unsaturated polyol ester is partially hydrogenated before it is subjected to the metathesis reaction. Partial hydrogenation of the unsaturated polyol ester reduces the number of double bonds that are available for in the subsequent metathesis reaction. In some embodiments, the unsaturated polyol ester is metathesized to form a metathesized unsaturated polyol ester, and the metathesized unsaturated polyol ester is then hydrogenated (e.g., partially or fully hydrogenated) to form a hydrogenated metathesized unsaturated polyol ester.

Hydrogenation may be conducted according to any known method for hydrogenating double bond-containing compounds such as vegetable oils. In some embodiments, the unsaturated polyol ester or metathesized unsaturated polyol ester is hydrogenated in the presence of a nickel catalyst that has been chemically reduced with hydrogen to an active state. Commercial examples of supported nickel hydrogenation catalysts include those available under the trade designations "NYSOFACT", "NYSOSEL", and "NI 5248 D" (from Englehard Corporation, Iselin, N.H.). Additional supported nickel hydrogenation catalysts include those commercially available under the trade designations "PRICAT 9910", "PRICAT 9920", "PRICAT 9908", "PRICAT 9936" (from Johnson Matthey Catalysts, Ward Hill, Mass.).

In some embodiments, the hydrogenation catalyst comprising, for example, nickel, copper, palladium, platinum, molybdenum, iron, ruthenium, osmium, rhodium, or iridium. Combinations of metals may also be used. Useful catalyst may be heterogeneous or homogeneous. In some embodiments, the catalysts are supported nickel or sponge nickel type catalysts.

In some embodiments, the hydrogenation catalyst comprises nickel that has been chemically reduced with hydrogen to an active state (i.e., reduced nickel) provided on a support. In some embodiments, the support comprises porous silica (e.g., kieselguhr, infusorial, diatomaceous, or siliceous earth) or alumina. The catalysts are characterized by a high nickel surface area per gram of nickel.

In some embodiments, the particles of supported nickel catalyst are dispersed in a protective medium comprising hardened triacylglyceride, edible oil, or tallow. In an exemplary embodiment, the supported nickel catalyst is dispersed in the protective medium at a level of about 22 wt. % nickel.

Hydrogenation may be carried out in a batch or in a continuous process and may be partial hydrogenation or complete hydrogenation. In a representative batch process, a vacuum is pulled on the headspace of a stirred reaction vessel and the reaction vessel is charged with the material to be hydrogenated (e.g., RBD soybean oil or metathesized RBD soybean oil). The material is then heated to a desired temperature. Typically, the temperature ranges from about 50° C. to 350° C., for example, about 100° C. to 300° C. or about 150° C. to 250° C. The desired temperature may vary, for example, with hydrogen gas pressure. Typically, a higher gas pressure will require a lower temperature. In a separate container, the hydrogenation catalyst is weighed into a mixing vessel and is slurried in a small amount of the material to be hydrogenated (e.g., RBD soybean oil or metathesized RBD soybean oil). When the material to be hydrogenated reaches the desired temperature, the slurry of hydrogenation catalyst is added to the reaction vessel. Hydrogen gas is then pumped into the reaction vessel to achieve a desired pressure of H2 gas. Typically, the H2 gas pressure ranges from about 15 to 3000 psig, for example, about 15 psig to 90 psig. As the gas pressure increases, more specialized high-pressure processing equipment may be required. Under these conditions the hydrogenation reaction begins and the temperature is allowed to increase to the desired hydrogenation temperature (e.g., about 120° C. to 200° C.) where it is maintained by cooling the reaction mass, for example, with cooling coils. When the desired degree of hydrogenation is reached, the reaction mass is cooled to the desired filtration temperature.

The amount of hydrogenation catalysts is typically selected in view of a number of factors including, for example, the type of hydrogenation catalyst used, the amount of hydrogenation catalyst used, the degree of unsaturation in the material to be hydrogenated, the desired rate of hydrogenation, the desired degree of hydrogenation (e.g., as measure by iodine value (IV)), the purity of the reagent, and the H2 gas pressure. In some embodiments, the hydrogenation catalyst is used in an amount of about 10 wt. % or less, for example, about 5 wt. % or less or about 1 wt. % or less.

After hydrogenation, the hydrogenation catalyst may be removed from the hydrogenated product using known techniques, for example, by filtration. In some embodiments, the hydrogenation catalyst is removed using a plate and frame filter such as those commercially available from Sparkler Filters, Inc., Conroe Tex. In some embodiments, the filtration is performed with the assistance of pressure or a vacuum. In order to improve filtering performance, a filter aid may be used. A filter aid may be added to the metathesized product directly or it may be applied to the filter. Representative examples of filtering aids include diatomaceous earth, silica, alumina, and carbon. Typically, the filtering aid is used in an amount of about 10 wt. % or less, for example, about 5 wt. % or less or about 1 wt. % or less. Other filtering techniques and filtering aids may also be employed to remove the used hydrogenation catalyst. In other embodiments the hydrogenation catalyst is removed using centrifugation followed by decantation of the product.

Additional Surface Softening Agents

In addition to the metathesized unsaturated polyol ester, other non-limiting examples of suitable surface softening agents that can be present in the surface softening composition of the present invention can be selected from the group consisting of: polymers such as polyethylene and derivatives thereof, hydrocarbons, waxes, oils, silicones, organosilicones (oil compatible), quaternary ammonium compounds, fluorocarbons, substituted $C_{10}$-$C_{22}$ alkanes, substituted $C_{10}$-$C_{22}$ alkenes, in particular derivatives of fatty alcohols and fatty acids (such as fatty acid amides, fatty acid condensates and fatty alcohol condensates), polyols, derivatives of polyols (such as esters and ethers), sugar derivatives (such as ethers and esters), polyglycols (such as polyethyleneglycol) and mixtures thereof.

In one example, the surface softening composition of the present invention is a microemulsion and/or a macroemulsion of a surface softening agent (for example an amino-functional polydimethylsiloxane, specifically an aminoethylaminopropyl polydimethylsiloxane) in water. In such an example, the concentration of the surface softening agent within the surface softening composition may be from about 3% to about 60% and/or from about 4% to about 50% and/or from about 5% to about 40%. Non-limiting examples of such microemulsions are commercially available from Wacker Chemie (MR1003, MR103, MR102). A non-limiting example of such a macroemulsion is commercially available from Momentive, Columbus, Ohio (CM849).

Non-limiting examples of suitable waxes may be selected from the group consisting of: paraffin, polyethylene waxes, beeswax and mixtures thereof.

Non-limiting examples of suitable oils may be selected from the group consisting of: mineral oil, silicone oil, silicone gels, petrolatum and mixtures thereof.

Non-limiting examples of suitable silicones may be selected from the group consisting of: polydimethylsiloxanes, aminosilicones, cationic silicones, quaternary silicones, silicone betaines and mixtures thereof.

Non-limiting examples of suitable polysiloxanes and/or monomeric/oligomeric units may be selected from the compounds having monomeric siloxane units of the following structure:

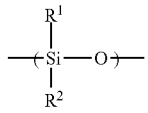

wherein, $R^1$ and R2, for each independent siloxane monomeric unit can each independently be hydrogen or any alkyl, aryl, alkenyl, alkaryl, arakyl, cycloalkyl, halogenated hydrocarbon, or other radical. Any of such radical can be substituted or unsubstituted. $R^1$ and $R^2$ radicals of any particular monomeric unit may differ from the corresponding functionalities of the next adjoining monomeric unit. Additionally, the polysiloxane can be either a straight chain, a branched chain or have a cyclic structure. The radicals $R^1$ and $R^2$ can additionally independently be other silaceous functionalities such as, but not limited to siloxanes, polysiloxanes, silanes, and polysilanes. The radicals $R^1$ and $R^2$ may contain any of a variety of organic functionalities including, for example, alcohol, carboxylic acid, phenyl, and amine functionalities. The end groups can be reactive (alkoxy or hydroxyl) or nonreactive (trimethylsiloxy). The polymer can be branched or unbranched.

In one example, suitable polysiloxanes include straight chain organopolysiloxane materials of the following general formula:

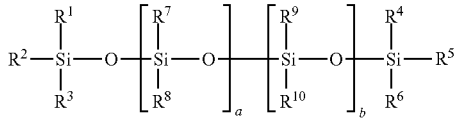

wherein each $R^1$-$R^9$ radical can independently be any $C_1$-$C_{10}$ unsubstituted alkyl or aryl radical, and $R^{10}$ of any substituted $C_1$-$C_{10}$ alkyl or aryl radical. In one example, each $R^1$-$R^9$ radical is independently any $C_1$-$C_4$ unsubstituted alkyl group. Those skilled in the art will recognize that technically there is no difference whether, for example, $R^9$ or $R^{10}$ is the substituted radical. In another example, the mole ratio of b to (a+b) is between 0 and about 20% and/or between 0 and about 10% and/or between about 1% and about 5%.

A non-limiting example of a cationic silicone polymer that can be used as a surface softening agent comprises one or more polysiloxane units, preferably polydimethylsiloxane units of formula $—\{(CH_3)_2SiO\}_c—$ having a degree of polymerization, c, of from about 1 to about 1000 and/or from about 20 to about 500 and/or from about 50 to about 300 and/or from about 100 to about 200, and organosilicone-free units comprising at least one diquaternary unit. In one example, the cationic silicone polymer has from about 0.05 to about 1.0 and/or from about 0.2 to about 0.95 and/or from about 0.5 to about 0.9 mole fraction of the organosilicone-free units selected from cationic divalent organic moieties. The cationic divalent organic moiety may be selected from N,N,N',N'-tetramethyl-1,6-hexanediammonium units.

The cationic silicone polymer may contain from about 0 to about 0.95 and/or from about 0.001 to about 0.5 and/or from about 0.05 to about 0.2 mole fraction of the total of organosilicone-free units, polyalkyleneoxide amines of the following formula:

$$[—Y—O(—C_aH_{2a}O)_b—Y—]$$

wherein Y is a divalent organic group comprising a secondary or tertiary amine, such as a $C_1$ to $C_8$ alkylenamine residue; a is from 2 to 4, and b is from 0 to 100.

Such polyalkyleneoxide amine-containing units can be obtained by introducing in the silicone polymer structure, compounds such as those sold under the tradename Jeffamine® from Huntsman Corporation. A preferred Jeffamine is Jeffamine ED-2003.

The cationic silicone polymer may contain from about 0 and/or from about 0.001 to about 0.2 mole fraction, of the total of organosilicone-free units, of $—NR_3+$ wherein R is alkyl, hydroxyalkyl or phenyl. These units can be thought of as end-caps.

Moreover the cationic silicone polymer generally contains anions, selected from inorganic and organic anions.

A non-limiting example of a cationic silicone polymer comprises one or more polysiloxane units and one or more quaternary nitrogen moieties, and includes polymers wherein the cationic silicone polymer has the formula:

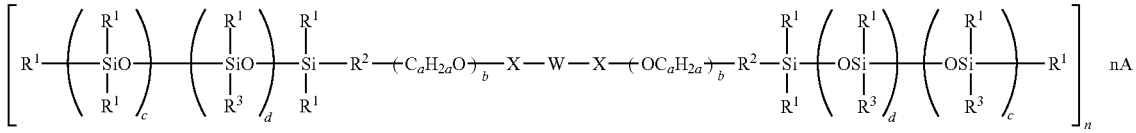

wherein:

$R^1$ is independently selected from the group consisting of: $C_{1-22}$ alkyl, $C_{2-22}$ alkenyl, $C_{6-22}$ alkylaryl, aryl, cycloalkyl, and mixtures thereof;

$R^2$ is independently selected from the group consisting of: divalent organic moieties that may contain one or more oxygen atoms (such moieties preferably consist essentially of C and H or of C, H and O);

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

Z is independently selected from the group consisting of monovalent organic moieties comprising at least one quaternized nitrogen atom;

a is from 2 to 4; b is from 0 to 100; c is from 1 to 1000 and/or greater than 20 and/or greater than 50 and/or less than 500 and/or less than 300 and/or from 100 to 200;

d is from 0 to 100; n is the number of positive charges associated with the cationic silicone polymer, which is greater than or equal to 2; and A is a monovalent anion.

Another non-limiting example of a cationic silicone polymer comprises one or more polysiloxane units and one or more quaternary nitrogen moieties, and includes polymers wherein the cationic silicone polymer has the formula:

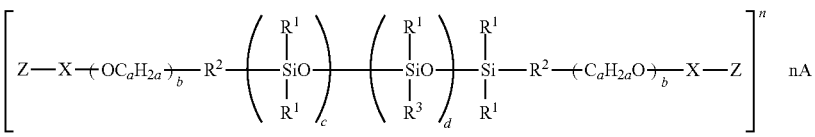

wherein:

$R^1$ is independently selected from the group consisting of: $C_{1-22}$ alkyl, $C_{2-22}$ alkenyl, $C_{6-22}$ alkylaryl, aryl, cycloalkyl, and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

X is independently selected from the group consisting of ring-opened epoxides;

W is independently selected from the group consisting of divalent organic moieties comprising at least one quaternized nitrogen atom;

a is from 2 to 4; b is from 0 to 100; c is from 1 to 1000 and/or greater than 20 and/or greater than 50 and/or less than 500 and/or less than 300 and/or from 100 to 200; d is from 0 to 100; n is the number of positive charges associated with the cationic silicone polymer, which is greater than or equal to 1; and A is a monovalent anion, in other words, a suitable counterion.

References disclosing non-limiting examples of suitable polysiloxanes include U.S. Pat. Nos. 2,826,551, 3,964,500, 4,364,837, 5,059,282, 5,529,665, 5,552,020 and British Patent No. 849,433 and *Silicone Compounds*, pp. 181-217, distributed by Petrach Systems, Inc., which contains an extensive listing and description of polysiloxanes in general.

Viscosity of polysiloxanes useful for this invention may vary as widely as the viscosity of polysiloxanes in general vary, so long as the polysiloxane can be rendered into a form which can be applied to the fibrous structures herein. This includes, but is not limited to, viscosity as low as about 10 centistokes to about 20,000,000 centistokes or even higher.

Non-limiting examples of suitable quaternary ammonium compounds may be selected from compounds having the formula:

$$[R^1]_{4-m}\overset{\oplus}{N}[R^2]_m \quad X^{\ominus}$$

wherein:

m is 1 to 3; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^2$ is independently a $C_{14}$-$C_{22}$ alkyl group, hydroxyalkyl group, hydrocarbyl or substituted hydrocarbyl group, alkoxylated group, benzyl group, or mixtures thereof; and $X^-$ is any quaternary ammonium-compatible anion.

In another example, the quaternary ammonium compounds may be mono or diester variations having the formula:

$$(R^1)_{4-m}—N+-[(CH_2)_n—Y—R^3]_m\ X^-$$

wherein:

Y is —O—(O)C—, or —C(O)—O—, or —NH—C(O)—, or —C(O)—NH—; m is 1 to 3; n is 0 to 4; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^3$ is independently a $C_{13}$-$C_{21}$ alkyl group, hydroxyalkyl group, hydrocarbyl or substituted hydrocarbyl group, alkoxylated group, benzyl group, or mixtures thereof, and $X^-$ is any quaternary ammonium-compatible anion.

In another example, the quaternary ammonium compound may be an imidazolinium compound, such as an imidazolinium salt.

As mentioned above, $X^-$ can be any quaternary ammonium-compatible anion, for example, acetate, chloride, bromide, methyl sulfate, formate, sulfate, nitrate and the like can also be used in the present invention. In one example, $X^-$ is chloride or methyl sulfate.

The surface softening composition may comprise additional ingredients such as a vehicle as described herein below which may not be present on the fibrous structure and/or sanitary tissue product comprising such fibrous structure. In one example, the surface softening composition may comprise a surface softening agent and a vehicle such as water to facilitate the application of the surface softening agent onto the surface of the fibrous structure.

Non-limiting examples of quaternary ammonium compounds suitable for use in the present invention include the well-known dialkyldimethylammonium salts such as ditallowdimethylammonium chloride, ditallowdimethylammonium methylsulfate, di(hydrogenated tallow)dimethylammonium chloride. In one example, the surface softening composition comprises di(hydrogenated tallow)dimethylammonium chloride, commercially available from Witco Chemical Company Inc. of Dublin, Ohio as Varisoft 137®.

Non-limiting examples of ester-functional quaternary ammonium compounds having the structures named above and suitable for use in the present invention include the well-known diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated) tallow dimethyl ammonium methyl sulfate, diester di(hydrogenated)tallow dimethyl ammonium chloride, and mixtures thereof. In one example, the surface softening composition comprises diester ditallow dimethyl ammonium chloride and/or diester di(hydrogenated)tallow dimethyl ammonium chloride, both commercially available from Witco Chemical Company Inc. of Dublin, Ohio under the tradename "ADOGEN SDMC".

Lotion Composition

In addition to the surface softening composition of the present invention, the fibrous structure may comprise a lotion composition. The lotion composition may comprise oils and/or emollients and/or waxes and/or immobilizing agents. In one example, the lotion composition comprises from about 10% to about 90% and/or from about 30% to about 90% and/or from about 40% to about 90% and/or from about 40% to about 85% of an oil and/or emollient. In another example, the lotion composition comprises from about 10% to about 50% and/or from about 15% to about 45% and/or from about 20% to about 40% of an immobilizing agent. In another example, the lotion composition comprises from about 0% to about 60% and/or from about 5% to about 50% and/or from about 5% to about 40% of petrolatum.

The lotion compositions may be heterogeneous. They may contain solids, gel structures, polymeric material, a multiplicity of phases (such as oily and water phase) and/or emulsified components. It may be difficult to determine precisely the melting temperature of the lotion composition, i.e. difficult to determine the temperature of transition between the liquid form, the quasi-liquid from, the quasi-solid form and the solid form. The terms melting temperature, melting point, transition point and transition temperature are used interchangeably in this document and have the same meaning.

The lotion compositions may be semi-solid, of high viscosity so they do not substantially flow without activation during the life of the product or gel structures.

The lotion compositions may be shear thinning and/or they may strongly change their viscosity around skin temperature to allow for transfer and easy spreading on a user's skin.

The lotion compositions may be in the form of emulsions and/or dispersions.

In one example of a lotion composition, the lotion composition has a water content of less than about 20% and/or less than 10% and/or less than about 5% or less than about 0.5%.

In another example, the lotion composition may have a solids content of at least about 15% and/or at least about 25% and/or at least about 30% and/or at least about 40% to about 100% and/or to about 95% and/or to about 90% and/or to about 80%.

A non-limiting example of a suitable lotion composition of the present invention comprises a chemical softening agent, such as an emollient, that softens, soothes, supples, coats, lubricates, or moisturizes the skin. The lotion composition may sooth, moisturize, and/or lubricate a user's skin.

The lotion composition may comprise an oil and/or an emollient. Non-limiting examples of suitable oils and/or emollients include glycols (such as propylene glycol and/or glycerine), polyglycols (such as triethylene glycol), petrolatum, fatty acids, fatty alcohols, fatty alcohol ethoxylates, fatty alcohol esters and fatty alcohol ethers, fatty acid ethoxylates, fatty acid amides and fatty acid esters, hydrocarbon oils (such as mineral oil), squalane, fluorinated emollients, silicone oil (such as dimethicone) and mixtures thereof.

Non-limiting examples of emollients useful in the present invention can be petroleum-based, fatty acid ester type, alkyl ethoxylate type, or mixtures of these materials. Suitable petroleum-based emollients include those hydrocarbons, or mixtures of hydrocarbons, having chain lengths of from 16 to 32 carbon atoms. Petroleum based hydrocarbons having these chain lengths include petrolatum (also known as "mineral wax," "petroleum jelly" and "mineral jelly"). Petrolatum usually refers to more viscous mixtures of hydrocarbons having from 16 to 32 carbon atoms. A suitable Petrolatum is available from Witco, Corp., Greenwich, Conn. as White Protopet® 1 S.

Suitable fatty acid ester emollients include those derived from long chain $C_{12}$-$C_{28}$ fatty acids, such as $C_{16}$-$C_{22}$ saturated fatty acids, and short chain $C_1$-$C_8$ monohydric alcohols, such as $C_1$-$C_3$ monohydric alcohols. Non-limiting examples of suitable fatty acid ester emollients include methyl palmitate, methyl stearate, isopropyl laurate, isopropyl myristate, isopropyl palmitate, and ethylhexyl palmitate. Suitable fatty acid ester emollients can also be derived from esters of longer chain fatty alcohols ($C_{12}$-$C_{28}$, such as $C_{12}$-$C_{16}$) and shorter chain fatty acids e.g., lactic acid, such as lauryl lactate and cetyl lactate.

Suitable fatty acid ester type emollients include those derived from $C_{12}$-$C_{28}$ fatty acids, such as $C_{16}$-$C_{22}$ saturated fatty acids, and short chain ($C_1$-$C_8$ and/or $C_1$-$C_3$) monohydric alcohols. Representative examples of such esters include methyl palmitate, methyl stearate, isopropyl laurate, isopropyl myristate, isopropyl palmitate, and ethylhexyl palmitate. Suitable fatty acid ester emollients can also be derived from esters of longer chain fatty alcohols ($C_{12}$-$C_{28}$ and/or $C_{12}$-$C_{16}$) and shorter chain fatty acids e.g., lactic acid, such as lauryl lactate and cetyl lactate.

Suitable alkyl ethoxylate type emollients include $C_{12}$-$C_{18}$ fatty alcohol ethoxylates having an average of from 3 to 30 oxyethylene units, such as from about 4 to about 23. Non-limiting examples of such alkyl ethoxylates include laureth-3 (a lauryl ethoxylate having an average of 3 oxyethylene units), laureth-23 (a lauryl ethoxylate having an average of 23 oxyethylene units), ceteth-10 (acetyl ethoxylate having an average of 10 oxyethylene units), steareth-2 (a stearyl ethoxylate having an average of 2 oxyethylene units) and steareth-10 (a stearyl ethoxylate having an average of 10 oxyethylene units). These alkyl ethoxylate emollients are typically used in combination with the petroleum-based emollients, such as petrolatum, at a weight ratio of alkyl ethoxylate emollient to petroleum-based emollient of from about 1:1 to about 1:3, preferably from about 1:1.5 to about 1:2.5.

The lotion compositions of the present invention may include an "immobilizing agent", so-called because they are believed to act to prevent migration of the emollient so that it can remain primarily on the surface of the fibrous structure to which it is applied so that it may deliver maximum softening benefit as well as be available for transferability to the user's skin. Suitable immobilizing agents for the present invention can comprise polyhydroxy fatty acid esters, polyhydroxy fatty acid amides, and mixtures thereof. To be useful as immobilizing agents, the polyhydroxy moiety of the ester or amide should have at least two free hydroxy groups. It is believed that these free hydroxy groups are the ones that co-crosslink through hydrogen bonds with the cellulosic fibers of the tissue paper web to which the lotion composition is applied and homo-crosslink, also through hydrogen bonds, the hydroxy groups of the ester or amide, thus entrapping and immobilizing the other components in the lotion matrix. Non-limiting examples of suitable esters and amides will have three or more free hydroxy groups on the polyhydroxy moiety and are typically nonionic in character. Because of the skin sensitivity of those using paper products to which the lotion composition is applied, these esters and amides should also be relatively mild and non-irritating to the skin.

Suitable polyhydroxy fatty acid esters for use in the present invention will have the formula:

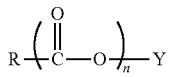

wherein R is a $C_5$-$C_{31}$ hydrocarbyl group, such as a straight chain $C_7$-$C_{19}$ alkyl or alkenyl and/or a straight chain $C_9$-$C_{17}$ alkyl or alkenyl and/or a straight chain $C_{11}$-$C_{17}$ alkyl or alkenyl, or mixture thereof; Y is a polyhydroxyhydrocarbyl moiety having a hydrocarbyl chain with at least 2 free hydroxyls directly connected to the chain; and n is at least 1. Suitable Y groups can be derived from polyols such as glycerol, pentaerythritol; sugars such as raffinose, maltodextrose, galactose, sucrose, glucose, xylose, fructose, maltose, lactose, mannose and erythrose; sugar alcohols such as erythritol, xylitol, malitol, mannitol and sorbitol; and anhydrides of sugar alcohols such as sorbitan.

One class of suitable polyhydroxy fatty acid esters for use in the present invention comprises certain sorbitan esters, such as sorbitan esters of $C_{16}$-$C_{22}$ saturated fatty acids.

Immobilizing agents include agents that are may prevent migration of the emollient into the fibrous structure such that the emollient remain primarily on the surface of the fibrous structure and/or sanitary tissue product and/or on the surface softening composition on a surface of the fibrous structure and/or sanitary tissue product and facilitate transfer of the lotion composition to a user's skin Immobilizing agents may function as viscosity increasing agents and/or gelling agents.

Non-limiting examples of suitable immobilizing agents include waxes (such as ceresin wax, ozokerite, microcrystalline wax, petroleum waxes, fisher tropsh waxes, silicone waxes, paraffin waxes), fatty alcohols (such as cetyl, cetaryl, cetearyl and/or stearyl alcohol), fatty acids and their salts (such as metal salts of stearic acid), mono and polyhydroxy fatty acid esters, mono and polyhydroxy fatty acid amides, silica and silica derivatives, gelling agents, thickeners and mixtures thereof.

In one example, the lotion composition comprises at least one immobilizing agent and at least one emollient.

Skin Benefit Agent

One or more skin benefit agents may be included in the lotion composition of the present invention. If a skin benefit agent is included in the lotion composition, it may be present in the lotion composition at a level of from about 0.5% to about 80% and/or 0.5% to about 70% and/or from about 5% to about 60% by weight of the lotion.

Non-limiting examples of skin benefit agents include zinc oxide, vitamins, such as Vitamin B3 and/or Vitamin E, sucrose esters of fatty acids, such as Sefose 1618S (commercially available from Procter & Gamble Chemicals), antiviral agents, anti-inflammatory compounds, lipid, inorganic anions, inorganic cations, protease inhibitors, sequestration agents, chamomile extracts, aloe vera, *calendula officinalis*, alpha bisalbolol, Vitamin E acetate and mixtures thereof.

Non-limiting examples of suitable skin benefit agents include fats, fatty acids, fatty acid esters, fatty alcohols, triglycerides, phospholipids, mineral oils, essential oils, sterols, sterol esters, emollients, waxes, humectants and combinations thereof.

In one example, the skin benefit agent may be any substance that has a higher affinity for oil over water and/or provides a skin health benefit by directly interacting with the skin. Suitable examples of such benefits include, but are not limited to, enhancing skin barrier function, enhancing moisturization and nourishing the skin.

The skin benefit agent may be alone, included in a lotion composition and/or included in a surface softening composition. A commercially available lotion composition comprising a skin benefit agent is Vaseline® Intensive Care Lotion (Chesebrough-Pond's, Inc.).

The lotion composition may be a transferable lotion composition. A transferable lotion composition comprises at least one component that is capable of being transferred to an opposing surface such as a user's skin upon use. In one example, at least 0.1% of the transferable lotion present on the user contacting surface transfers to the user's skin during use.

Other Ingredients

Other optional ingredients that may be included in the lotion composition include vehicles, perfumes, especially long lasting and/or enduring perfumes, antibacterial actives, antiviral actives, disinfectants, pharmaceutical actives, film formers, deodorants, opacifiers, astringents, solvents, cooling sensate agents, such as camphor, thymol and menthol.

Vehicle

As used herein a "vehicle" is a material that can be used to dilute and/or emulsify agents forming the surface softening composition and/or lotion composition to form a dispersion/emulsion. A vehicle may be present in the surface softening composition and/or lotion composition, especially during application of the surface softening composition and/or to the fibrous structure. A vehicle may dissolve a component (true solution or micellar solution) or a component may be dispersed throughout the vehicle (dispersion or emulsion). The vehicle of a suspension or emulsion is typically the continuous phase thereof. That is, other components of the dispersion or emulsion are dispersed on a molecular level or as discrete particles throughout the vehicle.

Suitable materials for use as the vehicle of the present invention include hydroxyl functional liquids, including but not limited to water. In one example, the lotion composition comprises less than about 20% and/or less than about 10% and/or less than about 5% and/or less than about 0.5% w/w of a vehicle, such as water. In one example, the surface softening composition comprises greater than about 50% and/or greater than about 70% and/or greater than about 85% and/or greater than about 95% and/or greater than about 98% w/w of a vehicle, such as water.

Process Aids

Process aids may also be used in the lotion compositions of the present invention. Non-limiting examples of suitable process aids include brighteners, such as TINOPAL CBS-X®, obtainable from CIBA-GEIGY of Greensboro, N.C.

NON-LIMITING EXAMPLES

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Non-limiting examples of product formulations disclosed in the present specification are summarized below.

Example 1

Large Batch Metathesis Reaction

In a 50-gallon batch reactor, the soybean oil (87 Kg) is degassed overnight (~16 hrs) with argon or nitrogen at an estimated rate of 10 mL/min. Degassing the soybean oil yields optimal catalyst efficiencies and prevents metathesis catalyst decomposition. The oil is then heated to 70° C. Ruthenium catalyst (Materia C827, CAS Number [253688-91-4], 4.2 g, 50 ppm) is added. The metathesis reaction is run for 2 hours, under an atmosphere of argon. The stir rate is not measured, but stirring is sufficient to cause a small amount of splash from the baffle. The metathesis catalyst is not removed prior to hydrogenation.

Metathesis Catalyst Removal Procedure

The metathesis catalyst is removed using THMP which is prepared by adding 245 g of tetrakishydroxymethyl phosphonium chloride (TKC) (1.03 mol, Cytec) and 500 mL of isopropyl alcohol (IPA) to a 2 L round-bottomed flask, degassing the mixture with nitrogen for 20 minutes, slowly adding 64 g (1.03 mol, 90% purity, Aldrich) of potassium hydroxide over 30 minutes to the vigorously stirring solution, while under a nitrogen atmosphere, and, after the potassium hydroxide is added, stirring the reaction for an additional 30 minutes. The reaction is exothermic, and produced THMP, formaldehyde, potassium chloride, and water. The catalyst is then removed using the THMP by adding 25-100 mol equivalents of THMP per mole of ruthenium catalyst, stirring vigorously at 60-70° C. for 18 to 24 hours under nitrogen, adding degassed water or methanol (about 150 mL/L of reaction mixture) and vigorously stirring for 10 minutes, and centrifuging the mixture for phase separation. This typically removes ruthenium to <1 ppm levels. The oil may have to be heated to remove the residual water or methanol. The aqueous phase will contain small amounts of IPA, formaldehyde, and potassium chloride, and will need to be purged or cleaned for recycling.

A second catalyst removal technique involves contacting the metathesis mixture with 5 wt % of Pure Flo 80 bleaching clay (i.e., 5 g bleaching clay/100 g metathesis mixture) for 4 hr at 70° C., followed by filtering the metathesis mixture through a plug of bleaching clay and sand. This technique typically removes ruthenium to <1 ppm levels.

Hydrogenation Procedure

The metathesis product can then be hydrogenated by heating the self-metathesized soybean oil to 350° F., while held under nitrogen, adding 0.4 wt % Ni catalyst to the oil once at 350° F., starting the flow of hydrogen at a pressure of 35 psi, having a hold temperature of about 410° F., and checking the reaction at 1 hour to see where the IV is in comparison to target. A 2.5 kg batch may take about 30-45 minutes. After about 2 hours (oil should be fully hydrogenated), nitrogen is put back in the vessel and the oil is cooled. The hydrogenated self-metathesized soybean oil may then be filtered to remove excess catalyst.

Example 2

Three sample metathesis products (A, C, and E) are subject to metathesis as described in EXAMPLE 1 to different degrees. These three metathesis products are hydrogenated, as described in EXAMPLE 1, to form hydrogenated versions of the metathesis products (B, D, and F).

Sample A is prepared starting with unrefined soybean oil (100 g) and 100 ppm of Materia catalyst C627. The reaction is run at room temperature for 20 hrs and is then warmed to 40° C. for 5 hrs. The metathesis catalyst is removed with THMP and water prior to hydrogenation.

Sample C is prepared starting with unrefined soybean oil (58 g) and 50 ppm of Materia catalyst C627. The reaction is run at room temperature for 22 hrs. The metathesis catalyst is not removed before hydrogenation.

Sample E is prepared starting with unrefined soybean oil (68 g) and 50 ppm of Materia catalyst C715. Materia catalyst C715 is the same as Materia catalyst C627, except that it has bromine ligands where Materia C627 has chlorine ligands. The self-metathesis reaction is run at room temperature for 22 hrs. The metathesis catalyst is removed with THMP and water prior to hydrogenation.

Example 3

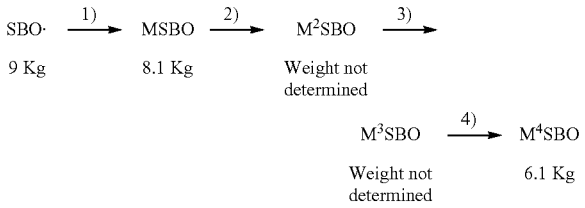

1) 9 ppm C827/toluene, 65° C., High vacuum, 180 min RXN time THMP treatment/Filtration Removal of lights
2) 50 ppm C827/toluene, 70° C. High vacuum, 180 min RXN time Removal of lights up to 247° C.
3) 1.7 ppm C827/toluene, 70° C. High vacuum, 45 min RXN time Removal of lights up to 136° C.
4) 2 ppm C827/toluene, 70° C. High vacuum, 45 min RXN time Example 4

1 gram Triolein in a flask is heated to 45° C. under N2 protection. 0.01 gram Grubbs 2nd generation catalyst is added. The reaction is kept at 45° C. for 16 hours and quenched with ethyl vinyl ether. The mixture is dissolved in Ethyl acetate and filtered through celite.

Example 5

A blend of metathesized and non-metathesized oils, such as polyol esters, is prepared according to the following surface softening compositions: A, B, C, and D in Table 1 below.

TABLE 1

| Material | A % by wt | B % by wt | C % by wt | D % by wt |
|---|---|---|---|---|
| Non-Metathesized Unsaturated, partially saturated, or saturated polyol ester and/or mixtures thereof | 50 | 25 | 10 | 0 |

TABLE 1-continued

| Material | A % by wt | B % by wt | C % by wt | D % by wt |
|---|---|---|---|---|
| Metathesized unsaturated polyol ester according to Examples 1-4 above and/or mixtures thereof | 50 | 75 | 90 | 100 |

Example 6

A non-limiting example of an emulsion of a metathesized unsaturated polyol ester is shown in Table 2 below. One of ordinary skill in the art appreciates that other emulsion forms and/or components thereof, such as different emulsifying agents, may be formed and/or used.

TABLE 2

| Material | A % by wt |
|---|---|
| Di(hydrogenated tallowalkyl) quaternary amine in isopropanol and water[1] | 1-4 |
| Glycerol monooleate[2] | 1-4 |
| Metathesized unsaturated polyol ester according to Examples 1-4 above and/or mixtures thereof and/or commercially available metathesized unsaturated polyol esters and/or blend thereof | 20 |
| Water | Balance |

[1]Available at Arquad 2-HT 75 from AkzoNobel
[2]Available as Capmul GMO-50 from Abitec Non-Limiting Examples of Fibrous Structures of the Present Invention Example 7

A 3% by weight aqueous slurry of NSK (northern softwood Kraft) is made in a conventional re-pulper. The NSK slurry is refined, and a 2% solution of Kymene 557LX is added to the NSK stock pipe at a rate sufficient to deliver 1% Kymene 557LX by weight of the dry fibers. The absorption of the wet strength resin is enhanced by passing the treated slurry though an in-line mixer. KYMENE 557LX is supplied by Hercules Corp of Wilmington, Del. A 1% solution of carboxy methyl cellulose is added after the in-line mixer at a rate of 0.15% by weight of the dry fibers to enhance the dry strength of the fibrous structure. The aqueous slurry of NSK fibers passes through a centrifugal stock pump to aid in distributing the CMC. An aqueous dispersion of DiTallow DiMethyl Ammonium Methyl Sulfate (DTDMAMS) (170° F./76.6° C.) at a concentration of 1% by weight is added to the NSK stock pipe at a rate of about 0.05% by weight DTDMAMS per ton of dry fiber weight.

A 3% by weight aqueous slurry of eucalyptus fibers is made in a conventional re-pulper. A 2% solution of Kymene 557LX is added to the eucalyptus stock pipe at a rate sufficient to deliver 0.25% Kymene 557LX by weight of the dry fibers. The absorption of the wet strength resin is enhanced by passing the treated slurry though an in-line mixer.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as separate layers until discharged onto a traveling Fourdrinier wire. A three-chambered headbox is used. The eucalyptus slurry containing 65% of the dry weight of the tissue ply is directed to the chamber leading to the layer in contact with the wire, while the NSK slurry comprising 35% of the dry weight of the ultimate tissue ply is directed to the chamber leading to the center and inside layer. The NSK and eucalyptus slurries are combined at the discharge of the headbox into a composite slurry.

The composite slurry is discharged onto the traveling Fourdrinier wire and is dewatered assisted by a deflector and vacuum boxes. The Fourdrinier wire is of a 5-shed, satin weave configuration having 105 machine-direction and 107 cross-machine-direction monofilaments per inch. The speed of the Fourdrinier wire is about 800 fpm (feet per minute).

The embryonic wet web is dewatered to a consistency of about 15% just prior to transfer to a patterned drying fabric made in accordance with U.S. Pat. No. 4,529,480. The speed of the patterned drying fabric is the same as the speed of the Fourdrinier wire. The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 9 mil above the supporting fabric. The drying fabric for forming the paper web has about 562 discrete deflection regions per square inch. The area of the continuous network is about 50 percent of the surface area of the drying fabric.

Further dewatering is accomplished by vacuum assisted drainage until the web has a fiber consistency of about 25%. While remaining in contact with the patterned drying fabric, the web is pre-dried by air blow-through pre-dryers to a fiber consistency of about 65% by weight. The web is then adhered to the surface of a yankee dryer, and removed from the surface of the dryer by a doctor blade at a consistency of about 97 percent. The Yankee dryer is operated at a surface speed of about 800 feet per minute. The dry web is passed through a rubber-on-steel calendar nip. The dry web is wound onto a roll at a speed of 680 feet per minute to provide dry foreshortening of about 15 percent. The resulting web has between about 562 and about 650 relatively low density domes per square inch (the number of domes in the web is between zero percent to about 15 percent greater than the number of cells in the drying fabric, due to dry foreshortening of the web).

Two plies are combined with the wire side facing out with plybond glue and/or mechanical polybonding wheels, to make the product. During the converting process, one or more surface softening compositions is applied via spraying and/or slot extruding to one or both outside surfaces of the product. The surface softening composition comprises a surface softening agent of the present invention; namely, one or more metathesized unsaturated polyol esters. Optionally, the product surface may comprise another surface softening composition, in combination with or discrete from the metathesized unsaturated polyol ester, that comprises a quaternary ammonium compound and/or a silicone softening agent and/or a non-metathesized polyol ester. The surface softening composition is applied to the product at a rate of 10% by weight. The product may be wound into a product roll, such as for toilet paper and/or paper towels, or can be slit, and then folded into finished 2-ply facial tissue product. The product(s) are tested in accordance with the test methods described below.

Example 8

A sheet with 32%×33%×35% layering consist of fabric layer, center layer and wire layer. The entire sheet has 70% by weight on a dry fiber basis of eucalyptus pulp fibers of the present invention and 30% by weight on a dry fiber basis of northern softwood kraft (NSK) pulp fibers is made.

An aqueous slurry of the eucalyptus pulp fibers is prepared at about 3% by weight using a conventional repulper. Separately, an aqueous slurry of the NSK pulp fibers of about 3% by weight is made up using a conventional repulper.

In order to impart temporary wet strength to the finished fibrous structure, a 1% dispersion of a temporary wet strength additive (e.g., Parez® commercially available from Kemira) is prepared and is added to the NSK fiber stock pipe at a rate sufficient to deliver 0.3% temporary wet strength additive based on the dry weight of the NSK pulp fibers. The absorption of the temporary wet strength additive is enhanced by passing the treated NSK pulp fiber slurry through an in-line mixer.

The eucalyptus pulp fiber slurry is diluted with white water at the inlet of a fan pump to a consistency of about 0.15% based on the total weight of the eucalyptus pulp fiber slurry. The NSK pulp fibers, likewise, are diluted with white water at the inlet of a fan pump to a consistency of about 0.15% based on the total weight of the NSK pulp fiber slurry. The eucalyptus pulp fiber slurry and the NSK pulp fiber slurry are both directed to a layered headbox capable of maintaining the slurries as separate streams until they are deposited onto a forming fabric on the Fourdrinier.

"DC 2310" (Dow Corning, Midland, Mich.) antifoam is dripped into the wirepit to control foam to maintain white water levels of 10 ppm.

The paper making machine has a layered headbox with a top chamber, a center chamber, and a bottom chamber. The eucalyptus pulp fiber slurry is pumped through the top and bottom headbox chambers and, simultaneously, the NSK pulp fiber slurry is pumped through the center headbox chamber and delivered in superposed relation onto a Fourdrinier wire to form thereon a three-layer embryonic web, of which about 70% is made up of the eucalyptus pulp fibers and about 30% is made up of the NSK pulp fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is about the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 98×62 filament, dual layer mesh. The thickness of the resin cast is about 12 mils above the supporting fabric.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. and a speed of about 800 fpm. The fibrous structure is wound in a roll using a surface driven reel drum having a surface speed of about 656 feet per minute.

Two plies are combined with the wire side facing out with plybond glue and/or mechanical polybonding wheels, to make the product. During the converting process, one or more surface softening compositions is applied via spraying and/or slot extruding to one or both outside surfaces of the product. The surface softening composition comprises a surface softening agent of the present invention; namely, one or more metathesized unsaturated polyol esters. Optionally, the product surface may comprise another surface softening composition, in combination with or discrete from the metathesized unsaturated polyol ester, that comprises a quaternary ammonium compound and/or a silicone softening agent and/or a non-metathesized polyol ester. The surface softening composition is applied to the product at a rate of 10% by weight. The product may be wound into a product roll, such as for toilet paper and/or paper towels, or can be slit, and then folded into finished 2-ply facial tissue product. The product(s) are tested in accordance with the test methods described below.

Example 9

A first stock chest of 100% eucalyptus fiber is prepared with a conventional pulper to have a consistency of about 3.0% by weight. The thick stock of the first hardwood chest is directed through a thick stock line where a wet-strength additive, HERCOBOND 1194 (commercially available from Ashland Inc.), is added in-line to the thick stock at about 0.5 lbs. per ton of dry fiber as it moves to the first fan pump.

A second stock chest of 100% eucalyptus fiber is prepared with a conventional pulper to have a consistency of about 3.0% by weight. The thick stock of the second chest is directed through a thick stock line where a wet-strength additive, HERCOBOND 1194, is added in-line to the thick stock at about 0.5 lbs. per ton of dry fiber as it moves to the second fan pump.

A third stock chest is prepared with 100% NSK fiber with a final consistency of about 3.0% by weight. The blended thick stock is directed to a disk refiner where it is refined to a Canadian Standard Freeness of about 580 to 625. The refined, NSK thick stock of the third stock chest is then directed through a thick stock line where a wet-strength additive, HERCOBOND 1194, is added to the thick stock at about 1.5 lbs. per ton of dry fiber. The refined, 100% NSK thick stock is then blended in-line with the eucalyptus thick stock from the second stock chest to yield a blended thick stock of about 55% eucalyptus and 45% NSK fiber as it is directed to the second fan pump.

A fourth stock chest of 100% trichome fiber is prepared with a conventional pulper to have a consistency of about 1.0% by weight. The thick stock of the fourth chest is directed through a thick stock line where it is blended in-line with the eucalyptus of the first stock chest to yield a blend of about 81% eucalyptus and 19% trichome fiber as it is directed to the first fan pump.

The blended eucalyptus and trichome fiber slurry diluted by the first fan pump is directed through the bottom headbox chamber (Yankee-side layer). The blend of eucalyptus fiber and NS K fiber slurry diluted by the second fan pump is directed through the center headbox chamber and to the top headbox chamber (Fabric-side) and is delivered in superposed relation to the fixed-roof former's forming wire to form thereon a three-layer embryonic web, of which about 34.5% of the top side is made up of blend of eucalyptus and NSK fibers, center is made up of about 34.5% of a blend of eucalyptus and NSK fibers and the bottom side (Yankee-side) is made up of about 31% of eucalyptus fibers and trichome fibers. Dewatering occurs through the outer wire and the inner wire and is assisted by wire vacuum boxes. Forming wire is an 84M design traveling at a speed of 800 fpm (feet per minute).

The embryonic wet web is transferred from the carrier (inner) wire, at a fiber consistency of about 24% at the point of transfer, to a patterned drying fabric. The speed of the patterned drying fabric is about 800 fpm (feet per minute). The drying fabric is designed to yield a pattern of substantially machine direction oriented linear channels having a continuous network of high density (knuckle) areas, such linear channels being the structure which imparts line elements to the web. This drying fabric is formed by casting an impervious resin surface onto a fiber mesh supporting fabric. The supporting fabric is a 127×52 filament, dual layer mesh. The thickness of the resin cast is about 12 mils above the supporting fabric.

While remaining in contact with the patterned drying fabric, the web is pre-dried by air blow-through pre-dryers to a fiber consistency of about 60% by weight.

After the pre-dryers, the semi-dry web is transferred to the Yankee dryer through a nip formed by the pressure roll surface and the Yankee surface where the Yankee surface has been pre-treated with a sprayed a creping adhesive coating. The coating is a blend consisting of Georgia Pacific's UNICREPE 457T20 and Vinylon Works' VINYLON 8844 at a ratio of about 92 to 8, respectively. The fiber consistency is increased to about 97% before the web is dry creped from the Yankee with a doctor blade.

The web is removed from the Yankee surface by a creping blade having a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 700 fpm (feet per minute). A surface softening composition is applied to at least one surface of the fibrous structure. The surface softening composition comprises a surface softening agent of the present invention; namely, one or more metathesized unsaturated polyol esters. Optionally, the product surface may comprise another surface softening composition, in combination with or discrete from the metathesized unsaturated polyol ester, that comprises a quaternary ammonium compound and/or a silicone softening agent and/or a non-metathesized polyol ester. In addition, the fibrous structure may be subjected to post treatments such as embossing and/or tuft generating. The fibrous structure may be subsequently converted into a two-ply sanitary tissue product having a basis weight of about 39 $g/m^2$. The plies of the two ply product are converted with Yankee-side surfaces out in order to form the consumer facing surfaces of the two-ply sanitary tissue product.

Example 10

A first stock chest of 100% eucalyptus fiber is prepared with a conventional pulper to have a consistency of about 3.0% by weight. The thick stock of the first hardwood chest is directed through a thick stock line where a wet-strength additive, HERCOBOND 1194 (commercially available from Ashland Inc.), is added in-line to the thick stock at about 0.5 lbs. per ton of dry fiber as it moves to the first fan pump.

Additionally, a second stock chest of 100% eucalyptus fiber is prepared with a conventional pulper to have a consistency of about 3.0% by weight. The thick stock of the second hardwood chest is directed through a thick stock line where a wet-strength additive, HERCOBOND 1194, is added in-line to the thick stock at about 0.5 lbs. per ton of dry fiber as it moves to the second fan pump.

A third stock chest is prepared with 100% NSK fiber with a final consistency of about 3.0%. The blended thick stock is directed to a disk refiner where it is refined to a Canadian Standard Freeness of about 580 to 625. The NSK thick stock of the third stock chest is then directed through a thick stock line where a wet-strength additive, HERCOBOND 1194, is added to the thick stock at about 1.5 lbs. per ton of dry fiber. The refined, 100% NSK thick stock is then directed to a third fan pump.

A fourth stock chest of 100% trichome fiber is prepared with a conventional pulper to have a consistency of about 1.0% by weight. The thick stock of the fourth chest is directed through a thick stock line where it is blended in-line with the eucalyptus fiber thick stock from the first stock chest to yield a blend of about 81% eucalyptus and 19% trichome fiber as it is directed to the first fan pump.

The blended eucalyptus and trichome fiber slurry diluted by the first fan pump is directed through the bottom headbox chamber (Yankee-side layer). The NSK fiber slurry diluted by the third fan pump is directed through the center headbox chamber. The eucalyptus fiber slurry diluted by the second fan pump directed to the top headbox chamber (Fabric-side) and delivered in superposed relation to the fixed-roof former's forming wire to form thereon a three-layer embryonic web, of which about 34.5% of the top side is made up of pure eucalyptus fibers, center is made up of about 34.5% of a NSK fiber and the bottom side (Yankee-side) is made up of about 31% of pure eucalyptus fiber. Dewatering occurs through the outer wire and the inner wire and is assisted by wire vacuum boxes. Forming wire is an 84M design traveling at a speed of 800 fpm (feet per minute).

The embryonic wet web is transferred from the carrier (inner) wire, at a fiber consistency of about 24% at the point of transfer, to a patterned drying fabric. The speed of the patterned drying fabric is about 800 fpm (feet per minute). The drying fabric is designed to yield a pattern of substantially machine direction oriented linear channels having a continuous network of high density (knuckle) areas. This drying fabric is formed by casting an impervious resin surface onto a fiber mesh supporting fabric. The supporting fabric is a 127×52 filament, dual layer mesh. The thickness of the resin cast is about 12 mils above the supporting fabric.

While remaining in contact with the patterned drying fabric, the web is pre-dried by air blow-through pre-dryers to a fiber consistency of about 60% by weight.

After the pre-dryers, the semi-dry web is transferred to the Yankee dryer through a nip formed by the pressure roll surface and the Yankee surface where the Yankee surface has been pre-treated with a sprayed a creping adhesive coating. The coating is a blend consisting of Georgia Pacific's UNICREPE 457T20 and Vinylon Works' VINYLON 8844 at a ratio of about 92 to 8, respectively. The fiber consistency is increased to about 97% before the web is dry creped from the Yankee with a doctor blade.

The web is removed from the Yankee surface by a creping blade having a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 700 fpm (feet per minute). A surface softening composition is applied to at least one surface of the fibrous structure. The surface softening composition comprises a surface softening agent of the present invention; namely, one or more metathesized unsaturated polyol esters. Optionally, the product surface may comprise another surface softening composition, in combination with or discrete from the metathesized unsaturated polyol ester, that comprises a quaternary ammonium compound and/or a silicone softening agent and/or a non-metathesized polyol ester. In addition, the fibrous structure may be subjected to post treatments such as embossing and/or tuft generating. The fibrous structure may be subsequently converted into a two-ply sanitary tissue product having a basis weight of about 48.8 $g/m^2$. The plies of the two ply product are converted with Yankee-side surfaces out in order to form the consumer facing surfaces of the two-ply sanitary tissue product.

Test Methods

Unless otherwise specified, all tests described herein including those described under the Definitions section and the following test methods are conducted on samples that have been conditioned in a conditioned room (CTCH room) at a temperature of 23° C.±1.0° C. and a relative humidity of 50%±2% for a minimum of 2 hours prior to the test. All plastic and paper board packaging articles of manufacture must be carefully removed from the paper samples prior to testing. The samples tested are "usable units." "Usable units" as used herein means sheets, flats from roll stock, pre-converted flats, and/or single or multi-ply products. Except where noted all tests are conducted in such conditioned room, all tests are conducted under the same environmental conditions and in such conditioned room. Discard any damaged product. Do not test samples that have defects such as wrinkles, tears, holes, and like. Samples conditioned as described herein are considered dry samples (such as "dry filaments") for testing purposes. All instruments are calibrated according to manufacturer's specifications.

Slip Stick Coefficient of Friction Test Method

Background

Friction is the force resisting the relative motion of solid surfaces, fluid layers, and material elements sliding against each other. Of particular interest here, 'dry' friction resists relative lateral motion of two solid surfaces in contact. Dry friction is subdivided into static friction between non-moving surfaces, and kinetic friction between moving surfaces.

"Slip Stick", as applied here, is the term used to describe the dynamic variation in kinetic friction.

Friction is not itself a fundamental force but arises from fundamental electromagnetic forces between the charged particles constituting the two contacting surfaces. Textured surfaces also involve mechanical interactions, as is the case when sandpaper drags against a fibrous substrate. The complexity of these interactions makes the calculation of friction from first principles impossible and necessitates the use of empirical methods for analysis and the development of theory. As such, a specific sled material and test method was identified, and has shown correlation to human perception of surface feel.

Figure 2:
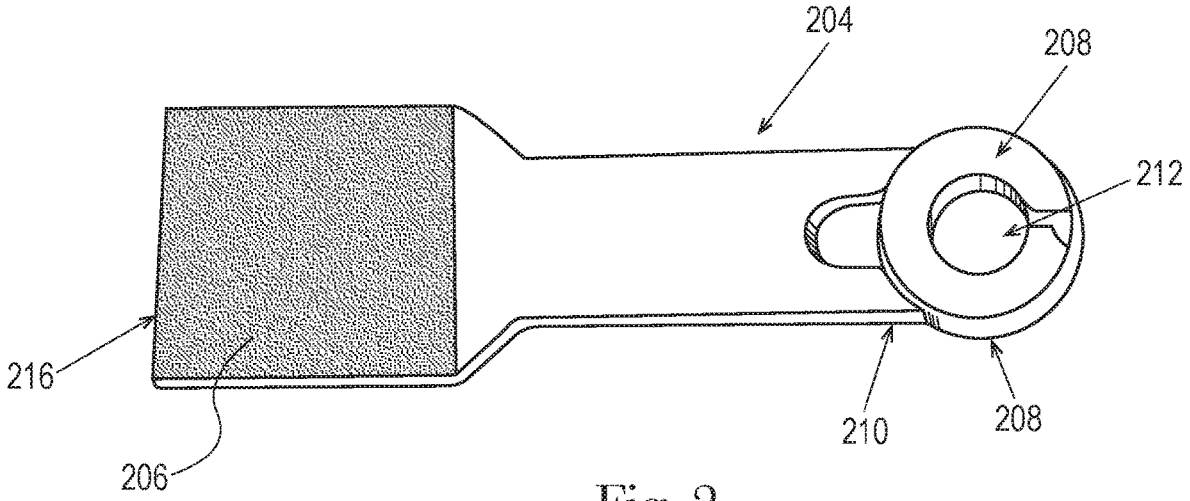
FIG. 2 is an image of a friction sled for use in the Slip Stick Coefficient of Friction Test Method.
Figure 3:
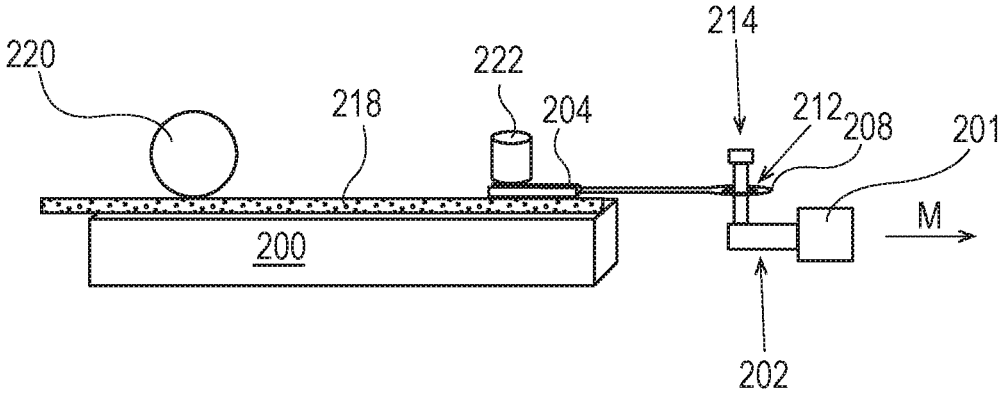
FIG. 3 is a schematic side view representation of a Slip Stick Coefficient of Friction Test Method set-up.

This Slip Stick Coefficient of Friction Test Method measures the interaction of a diamond file (120-140 grit) against a surface of a test sample, in this case a fibrous structure and/or sanitary tissue product, at a pressure of about 32 g/in$^2$ as shown in FIGS. 1-3. The friction measurements are highly dependent on the exactness of the sled material surface properties, and since each sled has no 'standard' reference, sled-to-sled surface property variation is accounted for by testing a test sample with multiple sleds, according to the equipment and procedure described below.

Equipment and Set-Up

A Thwing-Albert (14 W. Collings Ave., West Berlin, N.J.) friction/peel test instrument (model 225-1) or equivalent if no longer available, is used, equipped with data acquisition software and a calibrated 2000 gram load cell that moves horizontally across the platform. Attached to the load cell is a small metal fitting (defined here as the "load cell arm") which has a small hole near its end, such that a sled string can be attached (for this method, however, no string will be used). Into this load cell arm hole, insert a cap screw (¾ inch #8-32) by partially screwing it into the opening, so that it is rigid (not loose) and pointing vertically, perpendicular to the load cell arm.

After turning instrument on, set instrument test speed to 2 inches/min, test time to 10 seconds, and wait at least 5 minutes for instrument to warm up before re-zeroing the load cell (with nothing touching it) and testing. Force data from the load cell is acquired at a rate of 52 points per second, reported to the nearest 0.1 gram force. Press the 'Return' button to move crosshead 201 to its home position.

A smooth surfaced metal test platform 200, with dimensions of 5 inches by 4 inches by ¾ inch thick, is placed on top of the test instrument platen surface, on the left hand side of the load cell 203, with one of its 4 inch by ¾ inch sides facing towards the load cell 203, positioned 1.125 inches d from the left most tip of the load cell arm 202 as shown in FIGS. 1 and 3.

Sixteen test sleds 204 are required to perform this test (32 different sled surface faces). Each is made using a dual sided, wide faced diamond file 206 (25 mm×25 mm, 120/140 grit, 1.2 mm thick, McMaster-Carr part number 8142A14) with 2 flat metal washers 208 (approximately 11/16th inch outer diameter and about 11/32nd inch inner diameter). The combined weight of the diamond file 206 and 2 washers 208 is 11.7 grams+/−0.2 grams (choose different washers until weight is within this range). Using a metal bonding adhesive (Loctite 430, or similar), adhere the 2 washers 208 to the c-shaped end 210 of the diamond file 206 (one each on either face), aligned and positioned such that the opening 212 is large enough for the cap screw 214 to easily fit into, and to make the total length of sled 204 to approximately 3 inches long. Clean sled 204 by dipping it, diamond face end 216 only, into an acetone bath, while at the same time gently brushing with soft bristled toothbrush 3-6 times on both sides of the diamond file 206. Remove from acetone and pat dry each side with Kimwipe tissue (do not rub tissue on diamond surface, since this could break tissue pieces onto sled surface). Wait at least 15 minutes before using sled 204 in a test. Label each side of the sled 204 (on the arm or washer, not on the diamond face) with a unique identifier (i.e., the first sled is labeled "1*a*" on one side, and "1*b*" on its other side). When all 16 sleds 204 are created and labeled, there are then 32 different diamond face surfaces for available for testing, labeled 1*a* and 1*b* through 16*a* and 16*b*. These sleds 204 must be treated as fragile (particularly the diamond surfaces) and handled carefully; thus, they are stored in a slide box holder, or similar protective container.

Sample Prep

If sample to be tested is bath tissue, in perforated roll form, then gently remove 8 sets of 2 connected sheets from the roll, touching only the corners (not the regions where the test sled will contact). Use scissors or other sample cutter if needed. If sample is in another form, cut 8 sets of sample approximately 8 inches long in the MD, by approximately 4 inches long in the CD, one usable unit thick each. Make note and/or a mark that differentiates both face sides of each sample (e.g., fabric side or wire side, top or bottom, etc.). When sample prep is complete, there are 8 sheets prepared with appropriate marking that differentiates one side from the other. These will be referred to hereinafter as: sheets #1 through #8, each with a top side and a bottom side.

Test Operation

Press the 'Return' button to ensure crosshead 201 is in its home position.

Without touching test area of sample, place sheet #1 218 on test platform 200, top side facing up, aligning one of the sheet's CD edges (i.e. edge that is parallel to the CD) along the platform 218 edge closest to the load cell 202 (+/−1 mm). This first test (pull), of 32 total, will be in the MD direction on the top side of the sheet 218. Place a brass bar weight or equivalent 220 (1 inch diameter, 3.75 inches long) on the sheet 218, near its center, aligned perpendicular to the sled pull direction, to prevent sheet 218 from moving during the test. Place test sled "1*a*" 204 over cap screw head 214 (i.e., sled washer opening 212 over cap screw head 214, and sled side 1*a* is facing down) such that the diamond file 206 surface is laying flat and parallel on the sheet 218 surface and the cap screw 214 is touching the inside edge of the washers 208.

Gently place a cylindrically shaped brass 20 gram (+/−0.01 grams) weight 222 on top of the sled 204, with its edge aligned and centered with the sled's back end as shown in FIGS. 2 and 3. Initiate the sled movement M and data acquisition by pressing the 'Test' button on the instrument. The test set up is shown in FIG. 3. The computer collects the force (grams) data and, after approximately 10 seconds of test time, this first of 32 test pulls of the overall test is complete.

As shown in FIGS. 2 and 3, if the test pull was set-up correctly, the diamond file 206 face (25 mm by 25 mm square) stays in contact with the sheet 218 during the entire 10 second test time (i.e., does not overhang over the sheet 218 or test platform 200 edge). Also, if at any time during the test the sheet 218 moves, the test is invalid, and must be rerun on another untouched portion of the sheet 218, using a heavier brass bar weight or equivalent 220 to hold sheet 218 down. If the sheet 218 rips or tears, rerun the test on another untouched portion of the sheet 218 (or create a new sheet 218 from the sample). If it rips again, then replace the sled 204 with a different one (giving it the same sled name as the one it replaced). These statements apply to all 32 test pulls. For the second of 32 test pulls (also an MD pull, but in the opposite direction on the sheet), first remove the 20 gram weight 222, the sled 204, and the brass bar weight or equivalent 220 from the sheet 218. Press the 'Return' button on the instrument to reset the crosshead 201 to its home position. Rotate the sheet 218 180° (with top side still facing up), and replace the brass bar weight or equivalent 220 onto the sheet 218 (in the same position described previously). Place test sled "1*b*" 204 over the cap screw head 214 (i.e., sled washer opening 212 over cap screw head 214, and sled side 1*b* is facing down) and the 20 gram weight 222 on the sled 204, in the same manner as described previously. Press the 'Test' button to collect the data for the second test pull.

The third test pull will be in the CD direction. After removing the sled 204, weights 220, 222, and returning the crosshead 201, the sheet 218 is rotated 90° from its previous position (with top side still facing up), and positioned so that its MD edge is aligned with the test platform 200 edge (+/−1 mm). Position the sheet 218 such that the sled 204 will not touch any perforation, if present, or touch the area where the brass bar weight or equivalent 220 rested in previous test pulls. Place the brass bar weight or equivalent 220 onto the sheet 218 near its center, aligned perpendicular to the sled pull direction m. Place test sled "2*a*" 204 over the cap screw head 214 (i.e., sled washer opening 212 over cap screw head 214, and sled side 2*a* is facing down) and the 20 gram weight 222 on the sled 204, in the same manner as described previously. Press the 'Test' button to collect the data for the third test pull.

The fourth test pull will also be in the CD, but in the opposite direction and on the opposite half section of the sheet 218. After removing the sled 204, weights 220, 222, and returning the crosshead 201, the sheet 218 is rotated 180° from its previous position (with top side still facing up), and positioned so that its MD edge is again aligned with the test platform 200 edge (+/−1 mm). Position the sheet 218 such that the sled 204 will not touch any perforation, if present, or touch the area where the brass bar weight or equivalent 220 rested in previous test pulls. Place the brass bar weight or equivalent 220 onto the sheet 218 near its center, aligned perpendicular to the sled pull direction m. Place test sled "2*b*" 204 over the cap screw head 214 (i.e., sled washer opening 212 over cap screw head 214, and sled side 2*b* is facing down) and the 20 gram weight 222 on the sled 204, in the same manner as described previously. Press the 'Test' button to collect the data for the fourth test pull.

After the fourth test pull is complete, remove the sled 204, weights 220, 222, and return the crosshead 201 to the home position. Sheet #1 218 is discarded.

Test pulls 5-8 are performed in the same manner as 1-4, except that sheet #2 218 has its bottom side now facing upward, and sleds 3*a*, 3*b*, 4*a*, and 4*b* are used.

Test pulls 9-12 are performed in the same manner as 1-4, except that sheet #3 218 has its top side facing upward, and sleds 5*a*, 5*b*, 6*a*, and 6*b* are used.

Test pulls 13-16 are performed in the same manner as 1-4, except that sheet #4 218 has its bottom side facing upward, and sleds 7*a*, 7*b*, 8*a*, and 8*b* are used.

Test pulls 17-20 are performed in the same manner as 1-4, except that sheet #5 218 has its top side facing upward, and sleds 9*a*, 9*b*, 10*a*, and 10*b* are used.

Test pulls 21-24 are performed in the same manner as 1-4, except that sheet #6 218 has its bottom side facing upward, and sleds 11*a*, 11*b*, 12*a*, and 12*b* are used.

Test pulls 25-28 are performed in the same manner as 1-4, except that sheet #7 218 has its top side facing upward, and sleds 13*a*, 13*b*, 14*a*, and 14*b* are used.

Test pulls 29-32 are performed in the same manner as 1-4, except that sheet #8 218 has its bottom side facing upward, and sleds 15*a*, 15*b*, 16*a*, and 16*b* are used.

Calculations and Results

The collected force data (grams) is used to calculate Slip Stick COF for each of the 32 test pulls, and subsequently the overall average Slip Stick COF for the sample being tested. In order to calculate Slip Stick COF for each test pull, the following calculations are made. First, the standard deviation is calculated for the force data centered on 131st data point (which is 2.5 seconds after the start of the test)+/−26 data points (i.e., the 53 data points that cover the range from 2.0 to 3.0 seconds). This standard deviation calculation is repeated for each subsequent data point, and stopped after the 493rd point (about 9.5 sec). The numerical average of these 363 standard deviation values is then divided by the sled weight (31.7 g) and multiplied by 10,000 to generate the Slip Stick COF*10,000 for each test pull. This calculation is repeated for all 32 test pulls. The numerical average of these 32 Slip Stick COF*10,000 values is the reported value of the Slip Stick COF*10,000 for the sample. For simplicity, it is referred to as just Slip Stick COF, or more simply as Slip Stick, without units (dimensionless), and is reported to the nearest 1.0.

Outliers and Noise

It is not uncommon, with this described method, to observe about one out of the 32 test pulls to exhibit force data with a harmonic wave of vibrations superimposed upon it. For whatever reason, the pulled sled periodically gets into a relatively high frequency, oscillating 'shaking' mode, which can be seen in graphed force vs. time. The sine wave-like noise was found to have a frequency of about 10 sec-1 and amplitude in the 3-5 grams force range. This adds a bias to the true Slip Stick result for that test; thus, it is appropriate for this test pull be treated as an outlier, the data removed, and replaced with a new test of that same scenario (e.g., CD top face) and sled number (e.g. 3*a*).

To get an estimate of the overall measurement noise, 'blanks' were run on the test instrument without any touching the load cell (i.e., no sled). The average force from these tests is zero grams, but the calculated Slip Stick COF was 66. Thus, it is speculated that, for this instrument measurement system, this value represents that absolute lower limit for Slip Stick COF.

Softness Test Method

As used herein, the term "TS7 Softness Value" refers to the amplitude of the peak arising between 6 and 7 kHZ, measured using the EMTEC Tissue Softness Analyzer ("TSA") (Emtec Electronic GmbH, Leipzig, Germany) as described below. TS7 Softness Value and is expressed as dB $V^2$ rms. Tissue webs and products produced according to the present disclosure generally have TS7 Softness Values less than about 10 dB $V^2$ rms, such as from about 8.5 to about 9.5 dB $V^2$ rms, and more preferably from about 9 to about 9.5 dB $V^2$ rms.

Sample softness was analyzed using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. The frequency analysis in the range of approximately 200 to 1000 Hz represents the surface smoothness or texture of the test piece. A high amplitude peak correlates to a rougher surface. A further peak in the frequency range between 6 and 7 kHZ represents the softness of the test piece. The peak in the frequency range between 6 and 7 kHZ is herein referred to as the TS7 Softness Value and is expressed as dB $V^2$ rms. The lower the amplitude of the peak occurring between 6 and 7 kHZ, the softer the test piece.

Test pieces may be either round with a diameter of 112.8 mm or square with dimensions of 100 mm by 100 mm. All test pieces are allowed to equilibrate at TAPPI standard temperature and humidity conditions for at least 24-hours prior to completing the TSA testing. Only one ply of tissue is tested. Multi-ply samples are separated into individual plies for testing. The test piece is placed in the TSA with the softer (dryer or Yankee) side of the test piece facing upward. Once the test piece is secured, measurement of the TS7 Softness Value is started via the PC. The PC records, process and stores all of the data according to standard TSA protocol. After the completion of the measurement the measured and calculated results are displayed. The reported TS7 Softness Value is the average of 5 replicates, each one with a new test piece.

All documents cited in the Detailed Description of the Invention are, in relevant part, incorporated by reference herein; the citation of any document is not to be construed as an admission that it is prior art with respect to the present invention. To the extent that any meaning or definition of the term in this written document conflicts with any meaning or definition of the term in a document incorporated by reference, the meaning or definition assigned to the term in this written document shall govern.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dry fibrous structure comprising pillows and knuckles, and comprising a surface comprising a first surface softening composition comprising a metathesized unsaturated polyol ester and a second surface softening composition comprising a silicone softening agent and/or a non-metathesized polyol ester, wherein the first surface softening composition and the second surface softening composition are non-transferable, wherein the fibrous structure exhibits a Slip Stick Coefficient of Friction of less than 300 as measured according to the Slip Stick Coefficient of Friction Test Method and exhibits a TS7 Softness Value of less than 7.5 as measured according to the Softness Test Method, wherein the metathesized unsaturated polyol ester has an iodine value (IV) that ranges from 5 to 100, wherein a number of metathesis repeating units of the metathesized unsaturated polyol ester is from 1 to about 100, and wherein the metathesized unsaturated polyol ester is partially hydrogenated.

2. The dry fibrous structure according to claim 1 wherein the metathesized unsaturated polyol ester is selected from the group consisting of: a metathesized natural oil composition comprising olefins, esters, and mixtures thereof; a metathesized natural oil composition having a number average molecular weight in the range of from about 100 g/mol to about 150,000 g/mol, a weight average molecular weight in the range of from about 1,000 g/mol to about 100,000 g/mol, a z-average molecular weight in the range of from about 5,000 g/mol to about 1,000,000 g/mol, and a polydispersity index of from about 1 to about 20, wherein the metathesized natural oil composition is metathesized at least once; and mixtures thereof.

3. The dry fibrous structure according to claim 1 wherein the metathesized unsaturated polyol ester is selected from the group consisting of a metathesized vegetable oil, a metathesized animal fat, a metathesized algae oil and mixtures thereof.

4. The dry fibrous structure according to claim 1 wherein the metathesized unsaturated polyol ester is selected from the group consisting of metathesized canola oil, metathesized rapeseed oil, metathesized coconut oil, metathesized corn oil, metathesized cottonseed oil, metathesized olive oil, metathesized palm oil, metathesized peanut oil, metathesized safflower oil, metathesized sesame oil, metathesized soybean oil, metathesized sunflower oil, metathesized linseed oil, metathesized palm kernel oil, metathesized tang oil, metathesized jatropha oil, metathesized mustard oil, metathesized castor oil, metathesized camelina oil, metathesized pennycress oil, metathesized derivatives of these oils, and mixtures thereof.

5. The dry fibrous structure according to claim 1 wherein the second surface softening composition is discrete from the first surface softening composition.

6. The dry fibrous structure according to claim 1 wherein the dry fibrous structure further comprises a lotion composition layer.

7. The dry fibrous structure according to claim 1 wherein the dry fibrous structure is a through-air-dried fibrous structure.

8. The dry fibrous structure according to claim 1 wherein the dry fibrous structure is a conventionally dried fibrous structure.

9. The dry fibrous structure according to claim 1 wherein the dry fibrous structure is belt creped.

10. The dry fibrous structure according to claim 1 wherein the dry fibrous structure is fabric creped.

11. The dry fibrous structure according to claim 1 wherein the first surface softening composition comprises a first discrete layer and the second surface softening composition comprises a second discrete layer.

12. A single- or multi-ply sanitary tissue product comprising a dry fibrous structure according to claim 1.

13. The sanitary tissue product according to claim 12 wherein the sanitary tissue product is toilet paper.

14. A process for treating a surface of a dry fibrous structure comprising pillows and knuckles, the process comprising the step of applying a first surface softening composition, the first surface softening composition comprising a metathesized unsaturated polyol ester to the surface of the dry fibrous structure, wherein the step of applying the first surface softening composition occurs during a converting process, wherein the metathesized unsaturated polyol ester has an iodine value (IV) that ranges from 5 to 100, wherein the metathesized unsaturated polyol ester is partially hydrogenated, wherein a number of metathesis repeating units of the metathesized unsaturated polyol ester is from 1 to about 100, and wherein the metathesized unsaturated polyol ester comprises a metathesis tetramer, wherein the process comprises the step of applying a second surface softening composition comprising a silicone softening agent and/or a non-metathesized polyol ester, and wherein the first surface softening composition and the second surface softening composition are non-transferable.

15. The process according to claim 14 wherein at least 10 #/ton of the first surface softening composition is applied to the surface of the dry fibrous structure.

16. The process according to claim 14 wherein the process further comprises the step of applying a lotion composition layer to the surface of the dry fibrous structure.

17. The process according to claim 14 wherein the process further comprises the step of applying the second surface softening composition is separate from the step of applying the first surface softening composition.

18. The process according to claim 14 wherein the first surface softening composition is applied as a first discrete layer and the second surface softening composition is applied as a second discrete layer.

* * * * *